United States Patent [19]

Bryan, Jr.

[11] Patent Number: 5,058,294

[45] Date of Patent: Oct. 22, 1991

[54] GRADE CONTROL SYSTEM FOR CONTINUOUS BUCKET EXCAVATORS

[76] Inventor: John F. Bryan, Jr., 4250 Lovers La. West, Dallas, Tex. 75209

[21] Appl. No.: 522,467

[22] Filed: May 14, 1990

Related U.S. Application Data

[63] Continuation of Ser. No. 445,928, Dec. 5, 1989, abandoned, which is a continuation of Ser. No. 313,447, Feb. 22, 1989, abandoned.

[51] Int. Cl.[5] ..... E02F 3/24

[52] U.S. Cl. ..... 37/190; 37/195; 37/189; 37/DIG. 19; 37/94; 33/264; 33/365

[58] Field of Search ..... 37/90, 91, 94, 189, 37/190, 195, DIG. 1, DIG. 13, DIG. 14, DIG. 19, DIG. 20; 33/264, 286, 288, 391, 365, 318

[56] References Cited

U.S. PATENT DOCUMENTS

| | | | |
|---|---|---|---|
| 1,982,851 | 12/1934 | Bassett et al. | 33/352 X |
| 2,044,150 | 6/1936 | Carlson | 33/351 X |
| 2,306,373 | 12/1942 | Belden | 33/365 X |
| 2,357,817 | 9/1944 | Foster | 33/365 X |
| 2,538,112 | 1/1951 | Maier | 33/264 |
| 3,896,571 | 7/1975 | Satterwhite | 37/190 |
| 3,897,109 | 7/1975 | Satterwhite | 299/39 |
| 3,974,580 | 8/1976 | Satterwhite | 37/189 |
| 3,982,340 | 9/1976 | Satterwhite | 37/190 |
| 3,982,341 | 9/1976 | Satterwhite | 37/190 |
| 3,987,564 | 10/1976 | Satterwhite | 37/190 |
| 3,997,990 | 12/1976 | Satterwhite | 37/189 |
| 4,003,148 | 1/1977 | Satterwhite | 37/190 |
| 4,030,217 | 6/1977 | Satterwhite | 37/190 |
| 4,063,375 | 12/1977 | Satterwhite | 37/190 |
| 4,069,605 | 1/1978 | Satterwhite | 37/190 |
| 4,155,181 | 5/1979 | Satterwhite | 37/190 |
| 4,156,977 | 6/1979 | Satterwhite | 37/190 |
| 4,157,623 | 6/1979 | Satterwhite | 37/190 |
| 4,162,584 | 7/1979 | Satterwhite | 37/190 |
| 4,180,927 | 1/1980 | Satterwhite | 37/190 |
| 4,183,158 | 1/1980 | Satterwhite | 37/190 |

*Primary Examiner*—Randolph A. Reese
*Assistant Examiner*—J. Russell McBee
*Attorney, Agent, or Firm*—John F. Bryan, Jr.

[57] ABSTRACT

This invention pertains to method and apparatus for accurate control of the cutting depth and grade for mobile excavating system excavators having a continuous bucket excavating system mounted at the leading end of a structural main frame. Such excavators have a rubber tire or crawler track undercarriage and dig while advancing on the freshly cut grade.

58 Claims, 16 Drawing Sheets

GRADE CONTROL SYSTEM FOR CONTINUOUS BUCKET EXCAVATORS

This application is a continuation of application Ser. No. 445,928, filed Dec. 5, 1989 and now abandoned, which is a continuation of Ser. No. 313,447, filed Feb. 22, 1989, now abandoned.

BACKGROUND AND SUMMARY

This invention pertains to the control of cutting depth and grade for bucket excavators of the general type shown in Satterwhite U.S. Pat. Nos. 3,896,571 and 3,974,580 and co-pending Bryan application entitled "Bucket Chain Excavator". Such excavators have a large bucket excavating means mounted on a structural main frame at the leading end of the machine. The bucket excavating means has two or more sections which are mounted on either side of extended frame members so that the bucket excavating means is the widest part of these excavators. Such machines thus have the unique capability of passing through a trench under excavation and advancing along its bottom. Closely following the bucket excavating means on the main frame is a separately mounted moldboard/skid plate assembly. The entire machine is supported on a crawler track or rubber tired undercarriage which can be raised or lowered. This movement adjusts the cutting depth of the excavating means relative to the ground contact plane of the undercarriage. The moldboard blade breaks up uncut material left between excavating means sections and scrapes the bottom of the cut clean, crowding loose materials forward to be picked up by the buckets. The bucket excavating means operates in an undercutting manner and these materials are carried, along with the freshly dug material, to be discharged onto a conveyor.

In normal, day-to-day operation, the excavator is routinely required to "ramp-down" to a predetermined cutting depth, to "hold grade", making any required changes thereto, and then to "ramp-up", back to a higher elevation.

The prior art, as typified by U.S. Pat. No. 4,069,605, discloses only the raw capability for digging downwardly or upwardly inclining ramps or making level cuts, but has failed to teach any means or method for doing these things in a stable, predictable, accurately controllable manner.

Prior to the present invention, grade control or the selection and regulation of depth of cut of the digging wheel, has been a difficult and uncertain task at best, such that even the most skilled operators have been unable to achieve consistently acceptable results. The effect of any control input has not been perceptible until the machine has advanced significantly, so that an action that seems appropriate frequently proves to be wholly incorrect.

This difficulty of operation has been compounded by interrelated control variables. Increasing the depth of cut, for instance, has been accomplished by optionally raising the front suspension point of the supporting undercarriage, or by similarly lowering the rear suspension point, or by some combination of these adjustments. An alternate means for increasing the depth has been raising the moldboard/skid plate, allowing the digging wheel to dig more deeply. In a like manner, the reverse of each of these actions might be used to reduce digging depth. It is characteristic of these machines that any deviation from grade will increase at an accelerating rate as the machine advances. This rate of deviation is determined by the relative elevations of the digging wheel and the moldboard/skid plate to the front and rear suspension points. In addition to the aforementioned delayed response, the operator has also been hampered by an absence of visual clues as to the relative positions of these several grade determining elements.

The objects of the present invention are to achieve a manageable grade control system by:

1) Maintaining the position of the grade determining elements in a disciplined, stable relationship.
2) Restricting grade control to adjustment of a single grade determining element.
3) Providing the operator with grade control information in a usable display format.

The present invention first recognizes that grade control of the excavator can be manageable only when the machine operates in a disciplined manner and has an inherent capability for making smooth, predictable grade transitions.

The invention comprises modifications to the excavator which incorporate the above characteristics into the machine operation. This is achieved by placing the bottom of the digging wheel, the blade edge, and the ground support points, i.e., the grade determining elements, in a flat plane as the machine is when configured to cut a constant grade, and then causing this plane to become a cylindrical surface of proportionately decreasing radius as the digging wheel is raised or lowered to initiate a change of grade. In effect, the constant grade configuration "flat plane" is a cylindrical surface of infinite radius.

This cylindrical surface is mutually tangent to the digging wheel and to the front and rear ground support elements and is in fact, the grade path for the excavator. The case of a track laying undercarriage differs somewhat from that of a wheeled system in that, the ideal tangency is at the front and rear track sections for upward, or concave, transitions and at the track section just behind the dynamic balance point of the excavator for downward, or convex, transitions. The cylindrical surface of transition becomes mutually tangent to the initial grade produced by the excavator and the new grade.

The moldboard/skid plate assembly has heretofore typically been raised or lowered at the operator's discretion in an effort to hold it at or very near grade elevation at all times as described by Satterwhite U.S. Pat. No. 4,069,605, or it has been positioned by a linkage means of arbitrary geometry.

Prior art has considered the moldboard to be positioned more or less in coordination with the digging wheel position, or by the operator, uncoordinated with other functions. The foregoing are shown in Satterwhite U.S. Pat. No. 4,069,605. The contribution made by the moldboard/skid plate to the function and control of the excavator has heretofore been neither fully understood nor disclosed.

In the present invention, elimination of moldboard blade edge position as a variable is a fundamental step towards grade control simplification in the context of the present invention. Elimination of that variable, along with fixing either the front end or the rear end undercarriage elevation, leaves only the elevation of the free end of the undercarriage as a grade controlling variable. This single variable feature reduces the operator's work load to a minimum and permits grade related information to be organized and displayed in a usable format.

DETAILED DESCRIPTION

Figure 1:
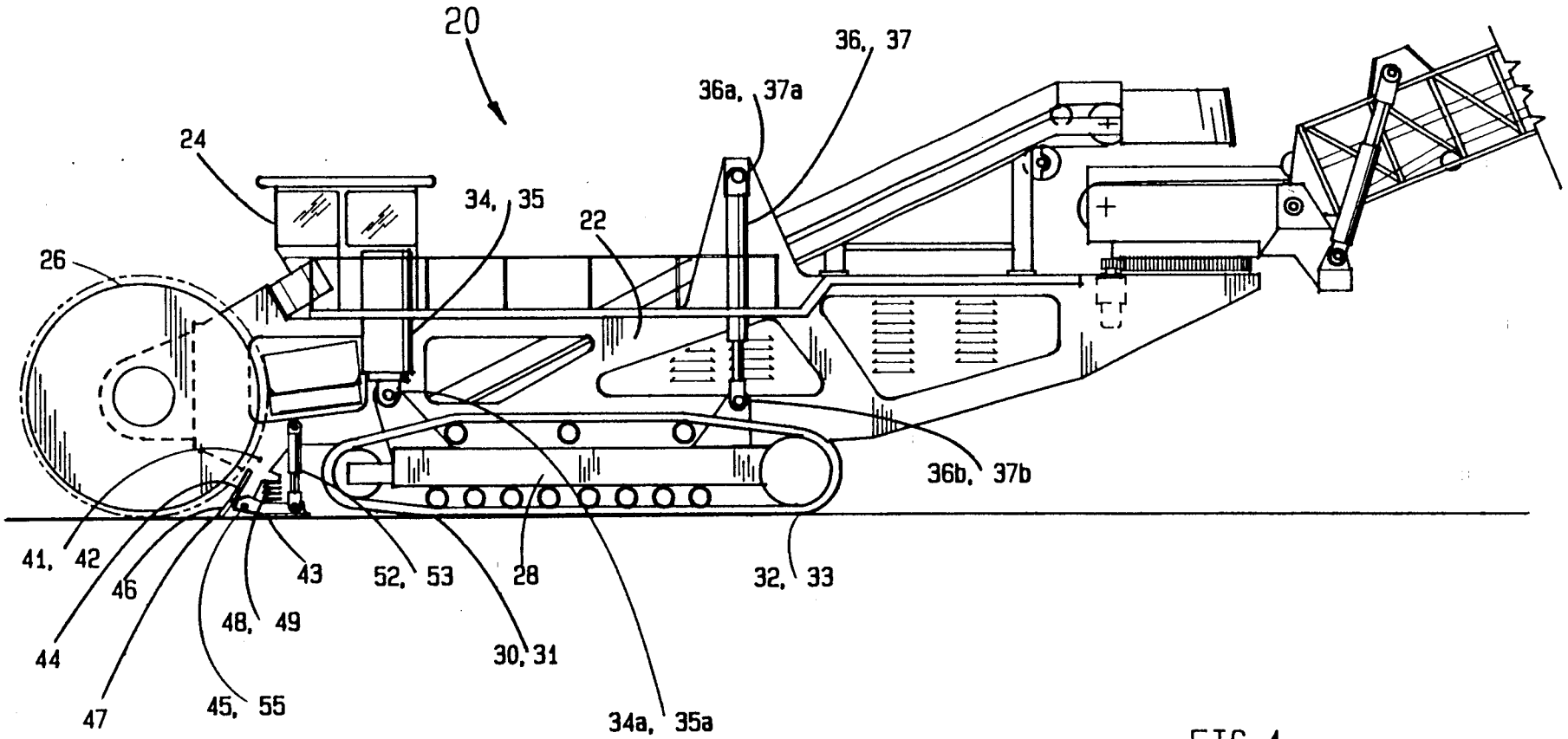
FIG. 1 is a side view of a track mounted version of a bucket wheel excavating machine utilizing the present invention in an embodiment characterized by a fixed moldboard and a fixed track front-end elevation wherein the rear-end track elevation is the grade controlling variable.

A preferred embodiment of the present invention comprises means for inherently holding the moldboard blade edge in close proximity to the surface cut by the digging wheel. This eliminates extraneous surface irregularities and thereby provides a predictable path for the forward undercarriage ground contact point. Need for independent moldboard/skid plate control means is obviated by a linkage or positioning system that maintains moldboard blade edge position relative to the cut surface as the elevation of one end of the undercarriage is altered to control the depth of cut. It is noteworthy that the bottom of the digging wheel, the blade edge, and the ground support points theoretically lie in the aforementioned cylindrical plane at all times. However, in actual practice, some modest compromise to this ideal geometry is allowable. The blade edge, for instance, is best held slightly above the cut grade so as to encounter a minimum of virgin material. Also, the elevation of the moldboard blade is preferably set a little above the "flat plane" to allow some clearance for initial penetration of the digging wheel at the start of a downward grade change. This initial penetration need only to be slight, since every change results in yet a greater change as the machine advances, and it will transition to any desired slope in a short distance.

The moldboard position can be fixed relative to the main frame if it is given enough edge clearance to avoid violation of the aforementioned cylindrical plane at all times. Leakage of loose material under the blade edge will be the limiting factor. Leakage material will tend to disturb the grade path but it will be penetrated or compacted to some degree by the undercarriage on passage. Leakage should be minimized in any case, and particularly in mining applications where this material is lost product.

In the preferred embodiment of the present invention, the function of the skid plate is not in any way related to control of grade except as a stabilizer for the digging wheel and the moldboard blade. The digging wheel rotates in an undercutting manner, thus the reaction to its cutting forces tends to force the wheel deeper into the cut. The skid plate supports the reaction force to the torque of the digging wheel and provides a stable foundation for both the digging wheel and the moldboard blade. The dimensions of the skid plate are determined by the bearing strength of the softest soil condition anticipated, so that, in a limiting case, the front end of the machine might be supported without bearing failure of the underlying soil.

On the other hand, a fixed moldboard position becomes impractical if the rear end of the undercarriage is fixed and front end elevation is varied for grade control purposes. Front end elevation changes make some form of variable moldboard positioning necessary in order to hold blade edge clearance within desirable limits. This can be achieved by kinematic design of a positioning linkage or by a programmed coordination of the actuators used to position the moldboard and front end elevation.

The present invention contemplates the need for visual display of grade related information in a usable format. Simplification of the control variables has the intrinsically beneficial effect of also simplifying the presentation of essential information to the operator. The factors which concern the operator can be reduced to an essential three, i.e., the existing grade, the relationship of the existing grade to a level plane, and the rate at which the existing grade is changing.

In the present invention, existing grade is defined as the plane upon which the machine undercarriage rests at any given time, be it inclined upwardly, downwardly, or tilted to either side. This information, in a preferred embodiment of the invention, takes the form of a line that is fixed in relationship to the undercarriage and is displayed to the operator as a right to left bar which is designated as the "Existing Grade" bar. Linkage to the undercarriage and the display of this bar may be achieved by mechanical, electrical or electronic means.

A "Level Grade" bar is also displayed. This bar is hidden by the "Existing Grade" and "Rate of Change" bars when the machine is working on a constant level grade and displaces proportionately above or below the "Existing Grade" bar in accordance with the slope of the undercarriage. Cross-level correction is called for when one end of the "Level Grade" bar appears higher than the other. A conventional two axis gravity level furnishes reference information for the "Level Grade" bar position in the preferred embodiment, with linkage and display being achieved by mechanical, electrical or electronic means.

Joining the "Rate of Change" bar to the "Existing Grade" bar by means of a flexible connecting member which does not inhibit relative movement of the bars aids interpretation of the display. The operator easily relates to the connecting member as a wing, the angle of incidence thereof being adjusted by grade control input, so that the wing is "flown" to merge smoothly with a targeted grade.

Variations of this three bar display, such as made by inverting the relationship of the above-designated "Existing Grade" bar position to the of the undercarriage and changing the order, alignment or presentation of the bar display may be made without departing from the spirit of the invention.

In the preferred embodiment, a gyroscopic artificial horizon instrument, as used as a reference for maneuvering aircraft under limited visibility conditions, such as disclosed in U.S. Pat. No. 1,982,851 and especially in U.S. Pat. No. 2,044,150, wherein the horizon indicator moves in the same sense as does the actual horizon, is mounted in the control cab in the field of view of the operator. The instrument is preferably mounted in such a way that the attitude thereof is maintained in relationship with undercarriage 28 and the existing grade but can also serve its purpose if mounted directly to the control cab. This instrument displays a gyroscopically stabilized horizon line and a reference indicator. The gyroscopically stabilized horizon indicator functions as the "Level Grade" bar and the reference indicator functions as the "Existing Grade" bar. "Rate of Change" information is, as previously described, developed from the relationship of the digging wheel depth setting to the "Existing Grade" by mechanically sensing an appropriate dimensional relationship between the undercarriage and the bucket wheel support structure and then transmitting this information for display to the operator by mechanical, electrical or electronic means. This display may either be integral to the instrument or it may be separate.

Referring now to the drawings, and particularly to FIG. 1, the preferred embodiment of an excavating and loading system 20 incorporating the invention is shown. The system 20 comprises a vehicle main frame 22 with a control cab 24 mounted thereon and a digging wheel 26 mounted to the front end thereof. Right and left orientation is established from the rear of said system looking forward. The system 20 is supported and moved on a crawler track type undercarriage 28 having a right and left forward ground contact points 30 and 31 and right and left rear ground contact points 32 and 33, the undercarriage 28 being attached to the main frame 22 for vertical movement by means of right and left front hydraulic cylinders 34 and 35 and right and left rear hydraulic cylinders 36 and 37. The front cylinders 34 and 35 are fixed rigidly to the main frame 22 so that the right and left pivotal connections **34*a* and 35*a* to the undercarriage 28 are constrained to move linearly with respect to the main frame 22, and are shown in the retracted position. The pivotal connections 34*a* and 35*a* are located forward of the forward ground contact points 30 and 31. Driving forces are transmitted from the crawler track undercarriage 28 to the main frame 22 through the rigid connection of the cylinders 34 and 35 thereto. The rear cylinders 36 and 37 have pivotal connections 36*a* and 37*a* respectively the main frame 22 and pivotal connections 36*b* and 37*b*** respectively to the undercarriage 28. Right and left moldboard bolsters 42 and 43 extend rigidly from main frame 22 and support the fixed moldboard 44 and the moldboard blade 46 having a cutting edge 47. The skid plate 43 is mounted to the lower end of bolsters 41 and 42 by pivotal connections 45 and 55 and is urged into contact with the underlying surface by right and left compression springs 48 and 49. Movement of the skid plate 43 is damped by right and left hydraulic damping cylinders 52 and 53 which are connected from the main frame 22 to the skid plate 43.

Figure 2:
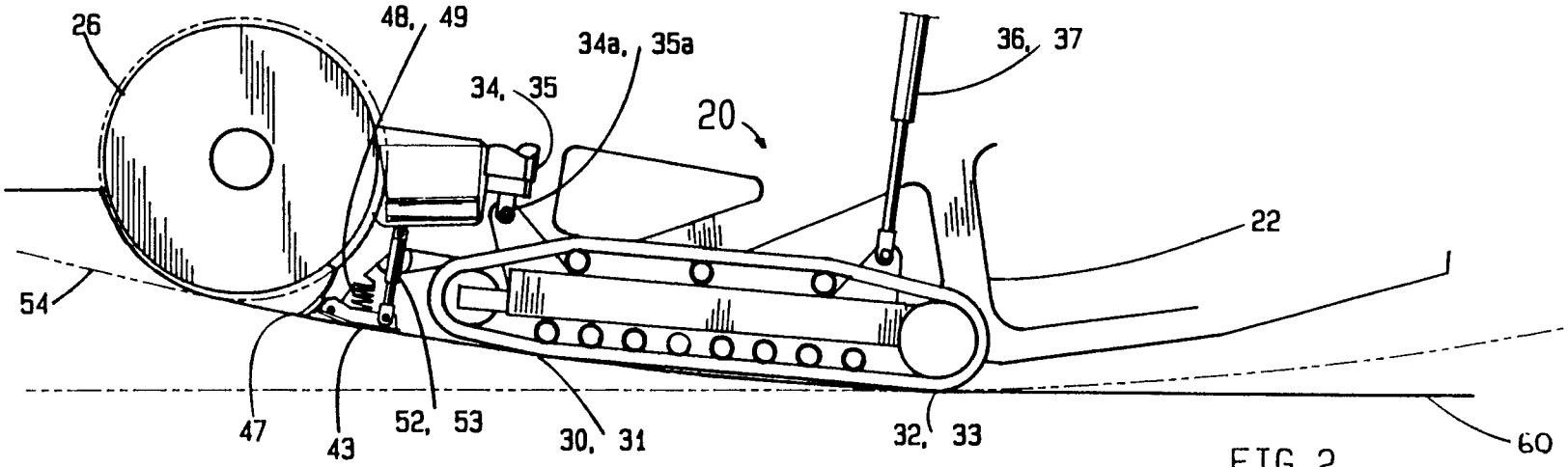
FIG. 2 is a side view of the excavator of FIG. 1 as it is configured for digging an upwardly directed transition.

FIG. 2 shows the excavating and loading system 20 configured for digging upwardly trending grade transitions. Retraction of right and left rear hydraulic cylinders 36 and 37 while the front hydraulic cylinders 34 and 35 are kept in the position of FIG. 1, causes the main frame 22 and digging wheel 26 to rotate around pivotal front cylinder connections 34*a* and 35*a*. This configuration defines as arc of transition 54 which represents a cylindrical surface that is mutually tangent to the undercarriage at front right and left ground contact points 30 and 31, and rear right and left ground contact points 32 and 33, and the digging wheel 26. The location of pivotal connections 34*a* and 35*a*, which was previously described as being forwarded of ground contact point 30 and 31, is now seen to be the means of maintaining the moldboard blade cutting edge 47 closely proximate to the cylindrical surface/arc 54. The surface of the cut represented by the transitional arc 54 is shown to depart from the constant grade 60 at an accelerating rate while skid plate 43 is positioned against this cylindrical surface/arc 54 by means of the compression springs 48 and 49 and hydraulic damping cylinders 52 and 53.

Figure 3:
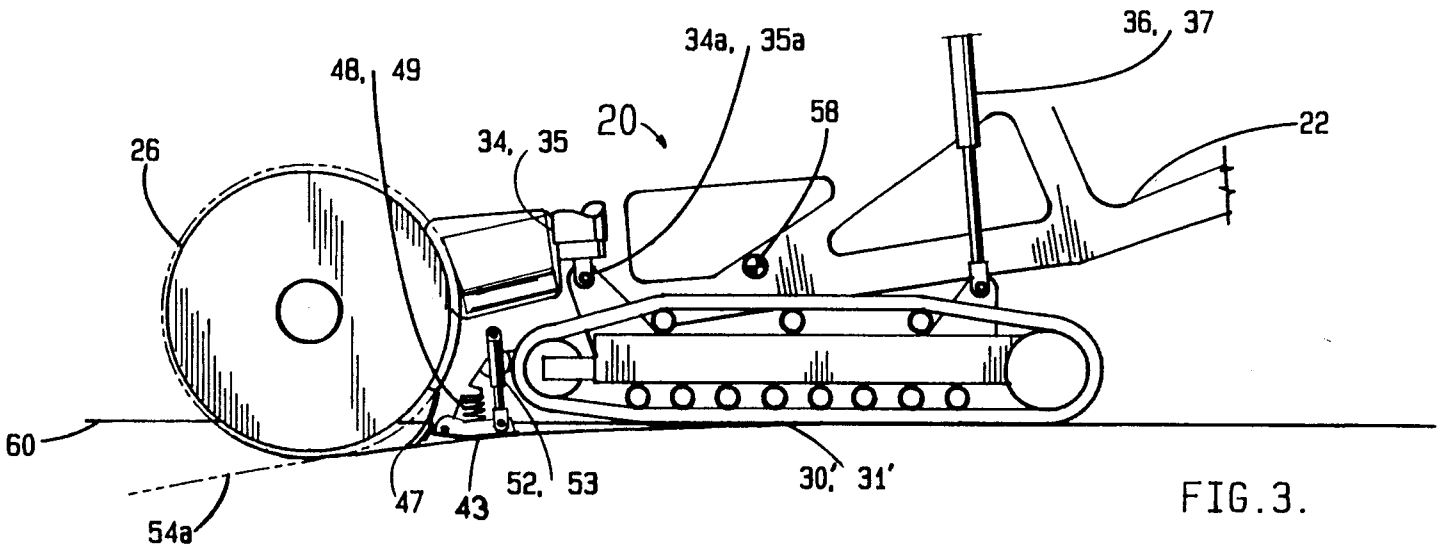
FIG. 3 is a side view of the excavator of FIG. 1 as it is configured for digging a downwardly directed transition.

FIG. 3 shows the excavating and loading system 20 configured for digging downwardly trending grade transitions. Extension of right and left rear hydraulic cylinders 36 and 37, while the front hydraulic cylinders 34 and 35 are maintained in the retracted position of FIG. 1 causes the main frame 22 and digging wheel 26 to rotate around front cylinder pivotal connections 34*a* and 35*a*. This configuration defines an arc of transition 54*a* which represents the cylindrical surface that is mutually tangent to the undercarriage at forward right and left ground contact points 30′ and 31′, located just behind the dynamic center of gravity 58 of the system 20, and to the digging wheel 26. The location of pivotal connections 34*a* and 35*a* again serve to maintain the proximity of moldboard blade edge 47 to the transitional arc 54*a*. The cylindrical surface represented by the transitional arc 54*a* is shown to depart from the constant grade 60 at an accelerating rate while the skid plate 43 is positioned against the cylindrical surface/arc 54*a* by means of the compression springs 48 and 49 and hydraulic damping cylinders 52 and 53.

Figure 4:
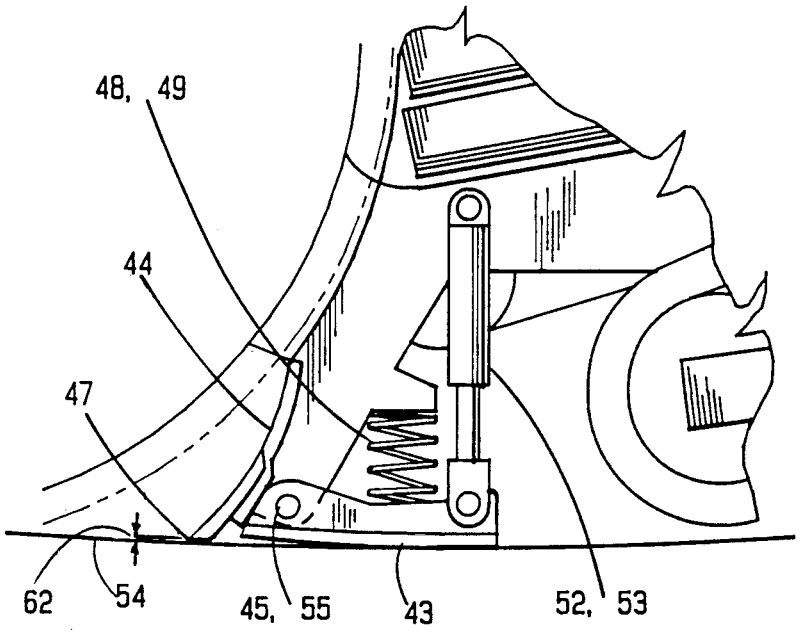
FIG. 4 is an enlarged view of the moldboard/skid plate assembly of FIG. 2.
Figure 5:
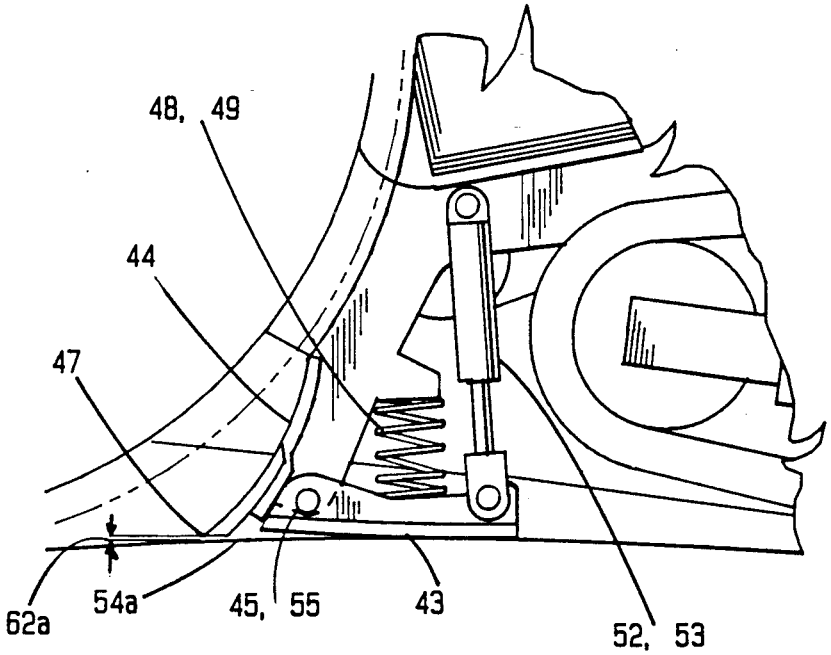
FIG. 5 is an enlarged view of the moldboard/skid plate assembly of FIG. 3.

FIG. 4, a detail view of FIG. 2, showing the moldboard 44 and adjacent excavator components, shows the skid plate 43 to be held in close contact with the cylindrical surface/arc 54 by the springs 48 and 49 and damping cylinders 52 and 53. This view further discloses the small clearance dimension 62 between the cylindrical surface/arc 54 and the moldboard blade edge 47. In a similar manner, FIG. 5, a detail view of FIG. 3, showing the moldboard 44 and adjacent excavator components, shows the skid plate 43 to be held in close contact with the cylindrical surface/arc 54*a* by the springs 48 and 49 and damping cylinders 52 and 53. This view further discloses a slightly increased clearance dimension 62*a* between the cylindrical surface/arc 54*a* and the moldboard blade edge 47.

Figure 6:
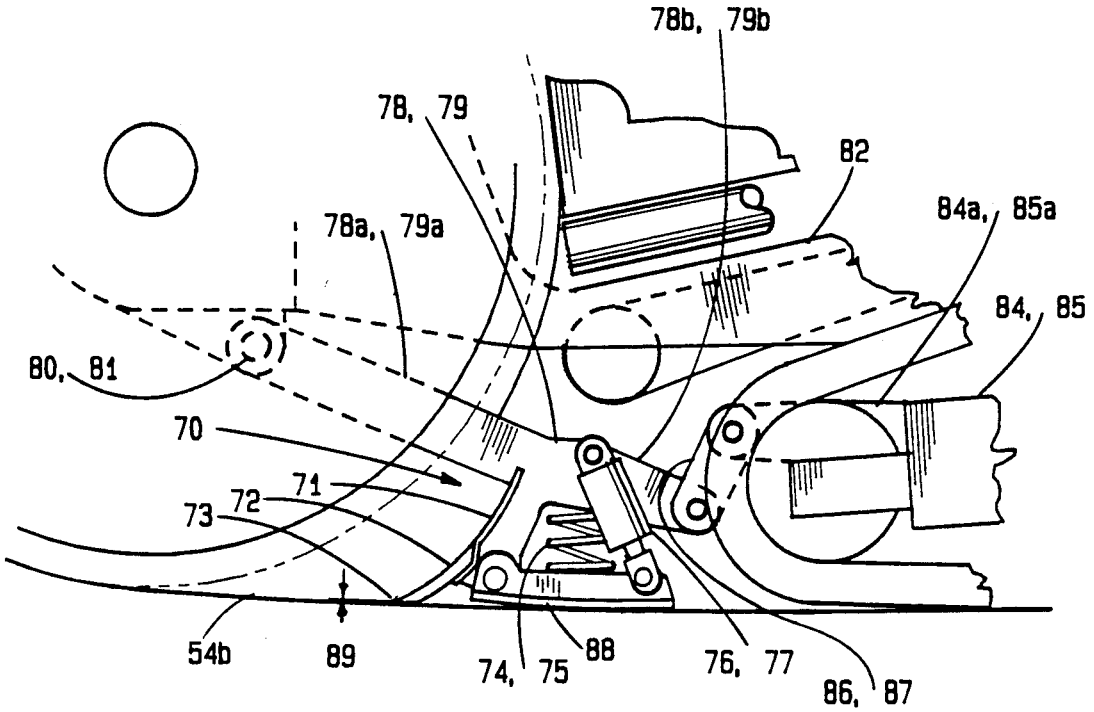
FIG. 6 is a side view of a moldboard/skid plate mounting linkage utilizing a pivotal connection to the main frame and radius arm connecting means to the track frame.
Figure 7:
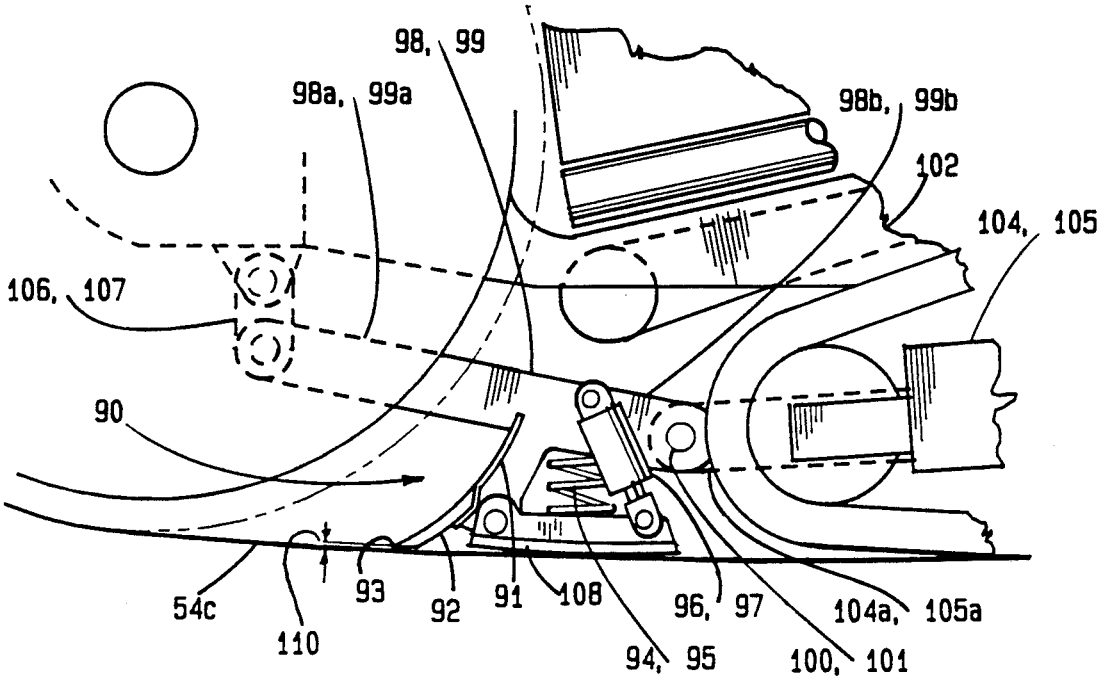
FIG. 7 is a side view of a moldboard/skid plate mounting linkage utilizing a pivotal connection to the track frame and radius arm connecting means to the main frame.

A second embodiment of an excavating and loading system which achieves grade control by means of front undercarriage elevation adjustment necessitates a variable height moldboard mounting of the general type shown in FIGS. 6 and 7. In FIG. 6, relative movement of the moldboard/skid plate assembly 70, comprising moldboard 71, moldboard blade 72, moldboard blade edge 73, right and left compression springs 74 and 75, and right and left hydraulic camping cylinders 76 and 77, and skid plate 88, is controlled by movement of the left and right crawler track assemblies 84 and 85. The aforesaid moldboard assembly 70 also comprises right and left moldboard connecting arms 78 and 79 which have leading portions 78*a* and 79*a*, and trailing portions 78*b* and 79*b*. The leading portions 78*a* and 79*a* are pivotally connected to the excavator main frame 82 by right and left pivot pins 80 and 81 while the trailing portions 78*b* and 79*b* are connected to extensions 84*a* and 85*a* of the right and left track assemblies 84 and 85 by means of right and left link assemblies 86 and 87. The link assemblies 86 and 87 hold the elevation of the trailing portions 78*b* and 79*b* approximately constant relative to that of the track assemblies 84 and 85 while the elevation of the leading portions 78*a* and 79*a* vary with relative movement of the main frame 82. Minor differences in side to side elevation is accommodated by torsional deflection of the moldboard 71 and moldboard blade 72. The relative movement of the moldboard blade edge 72 needed to maintain an acceptable clearance dimension 89 to the cylindrical surface/arc 54*b* while varying the elevation of the main frame 82, is determined by selection of the length ratio of leading portions 78*a* and 79*a* to that of the trailing portions 78*b* and 79*b*. Skid plate 88 is urged against cylindrical surface/arc 54*b* by compression springs 74 and 75 and damping cylinders 76 and 77.

The configuration of FIG. 7 behaves exactly as that of FIG. 6, in that relative movement of the moldboard/skid plate assembly 90, comprising moldboard 91, moldboard blade 92, moldboard blade edge 93, right and left compression springs 94 and 95, right and left hydraulic damping cylinders 96 and 97 and skid plate 108 is controlled by movement of the left and right crawler track assemblies 104 and 105. The aforesaid moldboard assembly 90 also comprises right and left moldboard connecting arms 98 and 99 which have leading portions 98*a* and 99*a*, and trailing portions 98*b* and 99*b*. The trailing portions 98*b* and 99*b* are attached to the extensions 104*a* and 105*a* of crawler track assemblies by right and left pivotal connections 100 and 101 while the leading portions 98*a* and 99*a* are connected to the main frame 102 by means of right and left link assemblies 106 and 107. The pivotal connections 100 and 101 hold the elevation of the trailing portions 98*b* and 99*b* approximately constant relative to that of the track assemblies 94 and 95 while the elevation of the leading portions 98*a* and 99*a* is varied by means of connecting link assemblies 106 and 107 with relative movement of the main frame 102. Minor differences in side to side elevation is accommodated by torsional deflection of the moldboard 91 and moldboard blade 92. The relative movement of the moldboard blade edge 93 needed to maintain an acceptable clearance dimension 110 to the cylindrical surface/arc 54*c* while varying the elevation of the main frame 102 is determined by selection of the length ratio of leading portions 98*a* and 99*a* to that of the trailing portions 98*b* and 99*b*. Skid plate 108 is urged against cylindrical surface/arc 54*c* by compression springs 94 and 95 and damping cylinders 96 and 97.

Figure 8:
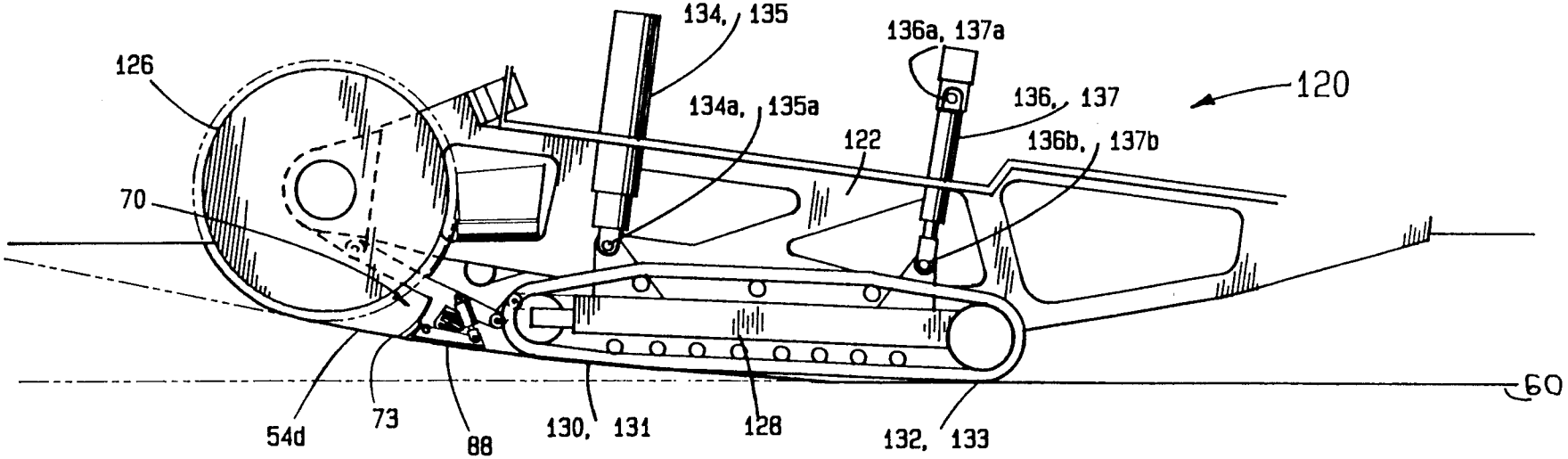
FIG. 8 is a side view of a track mounted version of a bucket wheel excavating machine utilizing the present invention in an embodiment characterized by the moldboard mounting linkage of FIG. 6 and a fixed track rear-end elevation wherein the front-end track elevation is the grade controlling variable as it is configured when digging an upwardly directed transition.

FIG. 8 shows an alternate embodiment of an excavating and loading system 120 incorporating the invention as it is configured to dig an upwardly trending grade transition 54*d*. In this case, right and left front hydraulic cylinders 134 and 135 are extended while the rear hydraulic cylinders 136 and 137 are kept in the nominal position as for digging a constant grade. Front cylinders 134 and 135 are rigidly fixed to the main frame 122 so that right and left pivotal connections 134*a* and 135*a* to undercarriage 128 are constrained to move linearly with respect to main frame 122. The main frame 122 and digging wheel 126 thus essentially rotate around right and left pivotal rear cylinder connections 136*a*, 137*a*, 136*b* and 137*b*. This configuration defines an arc of transition 54*d* which represents a cylindrical surface that is mutually tangent to the undercarriage at right and left forward ground contact points 130 and 131, right and left rear ground contact points 132 and 133, and the digging wheel 126. The moldboard/skid plate assembly 70 of FIG. 6 is employed to position moldboard blade edge 73 proximate to cylindrical surface/arc 54*d*. While skid plate 88 is positioned against skid surface/arc 54*d* in the manner of FIG. 6.

Figure 9:
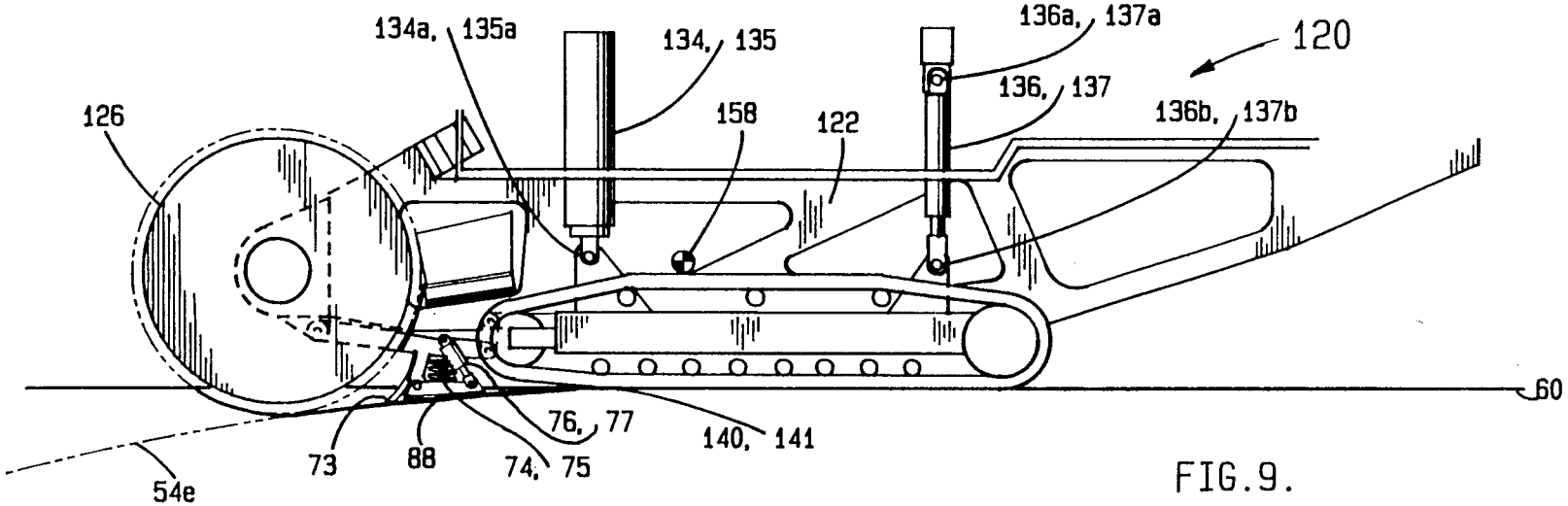
FIG. 9 is a side view of a track mounted version of a bucket wheel excavating machine utilizing the present invention in an embodiment characterized by the moldboard mounting linkage of FIG. 6 and a fixed track rear-end elevation wherein the front-end track elevation is the grade controlling variable as it is configured when digging a downwardly direct transition.

FIG. 9 shows the alternate embodiment of an excavating and loading system 120 incorporating the invention to dig a downwardly trending grade transition 54*e*. In this case, right and left front hydraulic cylinders 134 and 135 are retracted while the rear hydraulic cylinders 136 and 137 are kept in the nominal position as for digging a constant grade. Again, front cylinders 134 and 135 are rigidly fixed to the main frame 122 constraining right and left pivotal connections 134*a* and 135*a* to undercarriage 128 to move linearly with respect to main frame 122. The main frame 122 and digging wheel 126 thus essentially rotate around right and left pivotal rear cylinder connections 136*a* , 137*a* , 136*b* and 137*b*. This configuration defines the cylindrical surface/arc of transition 54*e* which is mutually tangent to the undercarriage at forward right and left ground contact points 140 and 141, located just behind the dynamic center of gravity 158 of the system 120, and to the digging wheel 126. The cylindrical surface/arc 54*e* is shown to depart from the constant grade 60 at an accelerating rate while the skid plate 88 is positioned against the cylindrical surface/arc 54*e* by means of the compression springs 74 and 75 and hydraulic damping cylinders 76 and 77. Again, the blade edge 73 is held proximate the surface/arc 54*e* in the manner of FIG. 6.

Figure 10:
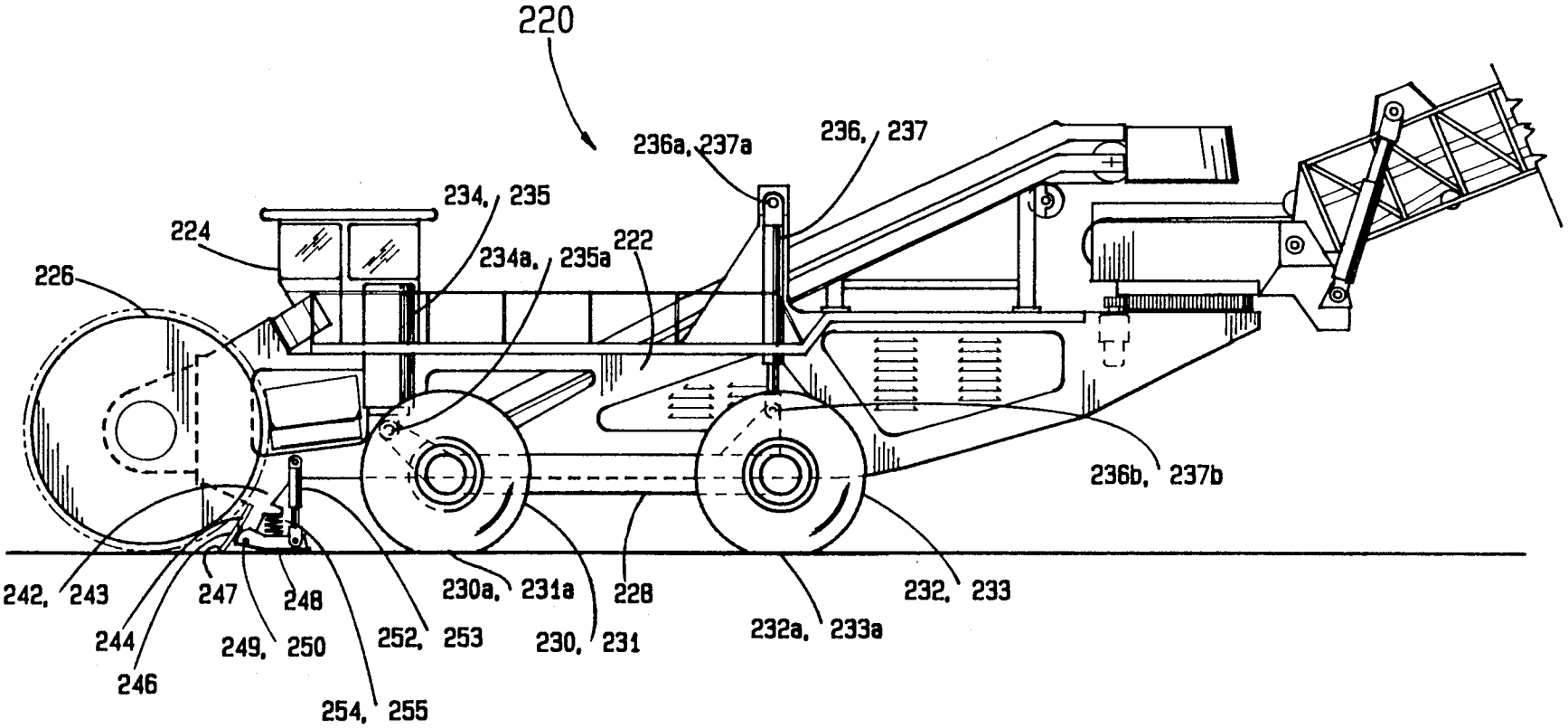
FIG. 10 is a side view of a wheel mounted version of a bucket wheel excavating machine utilizing the present invention in an embodiment characterized by a fixed moldboard and a fixed front wheel elevation wherein the rear wheel elevation is the grade controlling variable.

FIG. 10 shows a variation of the preferred embodiment of an excavating and loading system 220 incorporating the invention. The system 220 comprises a vehicle main frame 222 with a control cab 224 mounted thereon and a digging wheel 226 mounted to the front end thereof. The system 220 is supported and moved on a rubber tired undercarriage 228 having right and left front wheels 230 and 231 with ground contact patch centers 230*a* and 231*a* and right and left rear wheels 232 and 233 with ground contact patch centers 232*a* and 233*a*, the undercarriage 228 being attached to the main frame 222 for vertical movement by means of right and left front hydraulic cylinders 234 and 235 and right and left rear hydraulic cylinders 236 and 237. The front cylinders 234 and 235 are fixed rigidly to the main frame 222 so that the right and left pivotal connections 234*a* and 235*a* to the undercarriage 228 are constrained to move linearly with respect to the main frame 222, and are shown in the retracted position. The pivotal connections 234*a* and 235*a* are located forward of the forward ground contact patch centers 230*a* and 231*a*. Driving forces are transmitted from the undercarriage 228 to the main frame 222 through the rigid connection of the cylinders 234 and 235 thereto. The rear cylinders 236 and 237 have pivotal connections 236*a* and 237*a* respectively to the main frame 222 and pivotal connections 236*b* and 237*b* respectively to the undercarriage 228. Right and left moldboard bolsters 242 and 243 extend rigidly from main frame 222 and support the fixed moldboard 244 and the moldboard blade 246 having a cutting edge 247. The skid plate 248 is mounted to the lower end of bolsters 242 and 243 by pivotal connections 249 and 250 and is urged into contact with the underlying surface by right and left compression springs 254 and 255. Movement of the skid plate 248 is damped by right and left hydraulic damping cylinders 252 and 253 which are connected from the main frame 222 to the skid plate 248.

Figure 11:
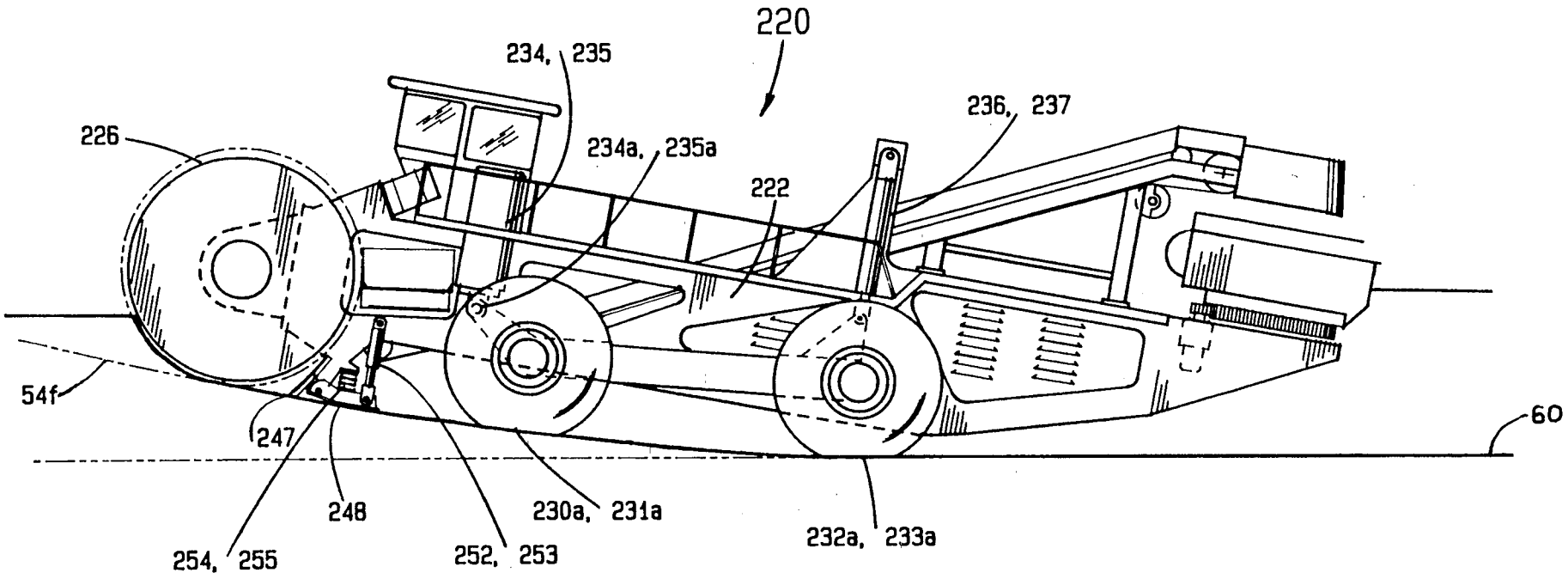
FIG. 11 is a side view of the excavator of FIG. 10 as it is configured for digging an upwardly directed transition.

FIG. 11 shows the excavating and loading system 220 configured for digging upwardly trending grade transition 54*f*. Retraction of right and left rear hydraulic cylinders 236 and 237 while the front hydraulic cylinders 234 and 235 are kept in the position of FIG. 10, causes the main frame 222 and digging wheel 226 to rotate around pivotal front cylinder connections 234*a* and 235*a*. This configuration defines the cylindrical surface/arc of transition 54*f* that is mutually tangent to right and left front ground patch centers 230*a* and 231*a*, right and left rear ground contact patch centers 232*a* and 233*a*, and the digging wheel 226. The location of pivotal connections 234*a* and 235*a*, which was previously described as being forward of ground contact patch centers 230*a* and 231*a*, is now seen to be the means of maintaining the position of the fixed moldboard blade cutting edge 247 close to the cylindrical surface/arc 54*f*. The surface of the cut represented by the transitional arc 54*f* is shown to depart from the constant grade 60 at an accelerating rate while the skid plate 248 is positioned against cylindrical surface/arc 54*f* by means of compression springs 254 and 255 and hydraulic damping cylinders 252 and 253.

Figure 12:
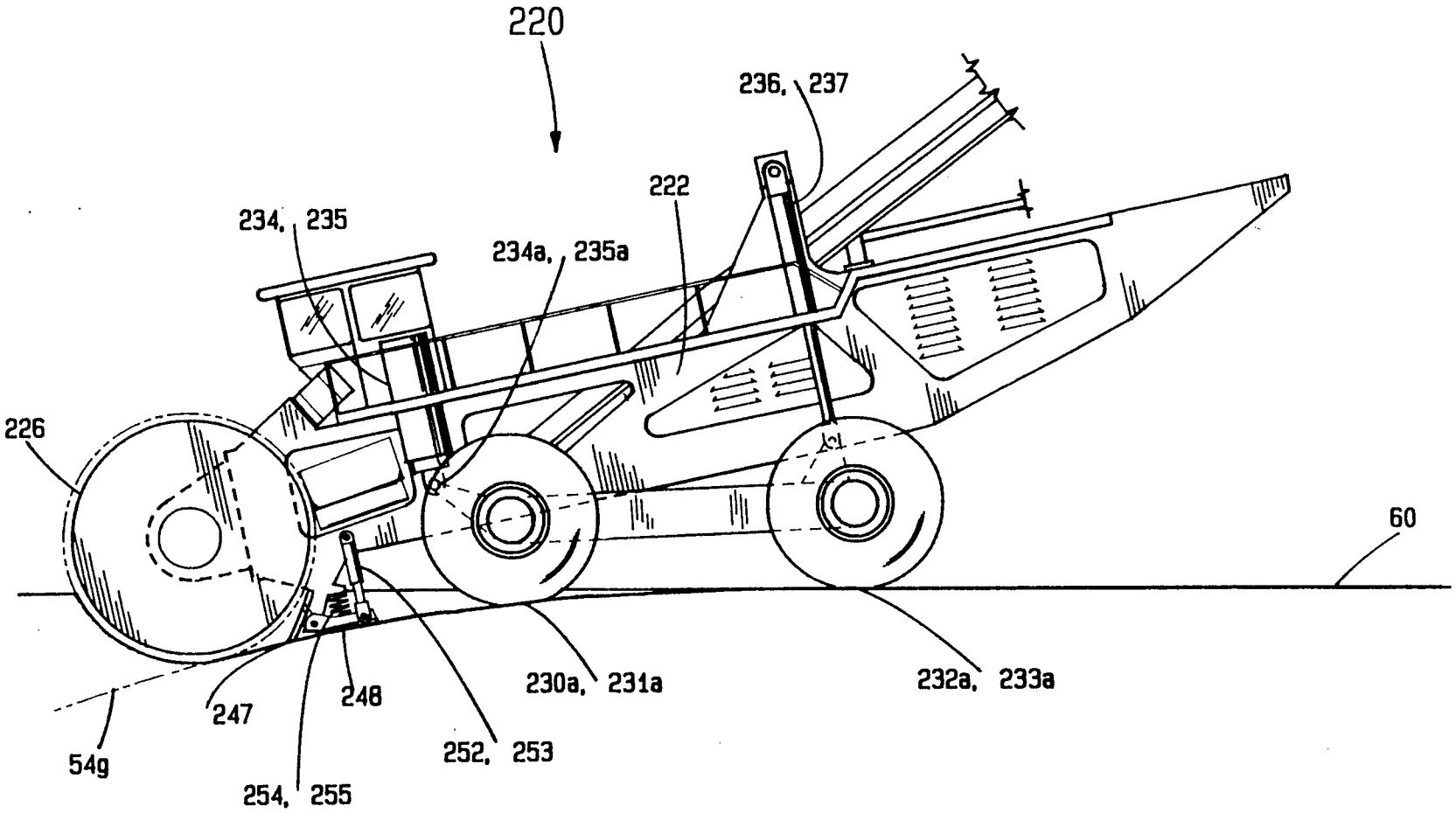
FIG. 12 is a side view of the excavator of FIG. 10 as it is configured for digging a downwardly directed transition.

FIG. 12 shows the excavating and loading system 220 configured for digging downwardly trending grade transition 54*g*. Extension of right and left rear hydraulic cylinders 236 and 237 while the front hydraulic cylinders 234 and 235 are maintained in the position of FIG. 10, causes the main frame 222 and digging wheel 226 to rotate around front cylinder pivotal connections 235*a* and 236*a*. This configuration defines the cylindrical surface/arc of transition 54*g* which is mutually tangent to right and left front ground patch centers 230*a* and 231*a*, right and left rear ground contact patch centers 232*a* and 233*a*, and the digging wheel 226. The location of pivotal connections 234*a* and 235*a*, which was previously described as being forward of ground contact patch centers 230*a* and 231*a*, is seen to be the means of maintaining the position of the fixed moldboard blade cutting edge 247 close to the cylindrical surface/arc 54*g*. The surface of the cut represented by the transitional arc 54*g* is shown to depart from the constant grade 60 at an accelerating rate while the skid plate 248 is positioned against cylindrical surface/arc 54*g* by means of compression springs 254 and 255 and hydraulic damping cylinders 242 and 253.

Figure 13:
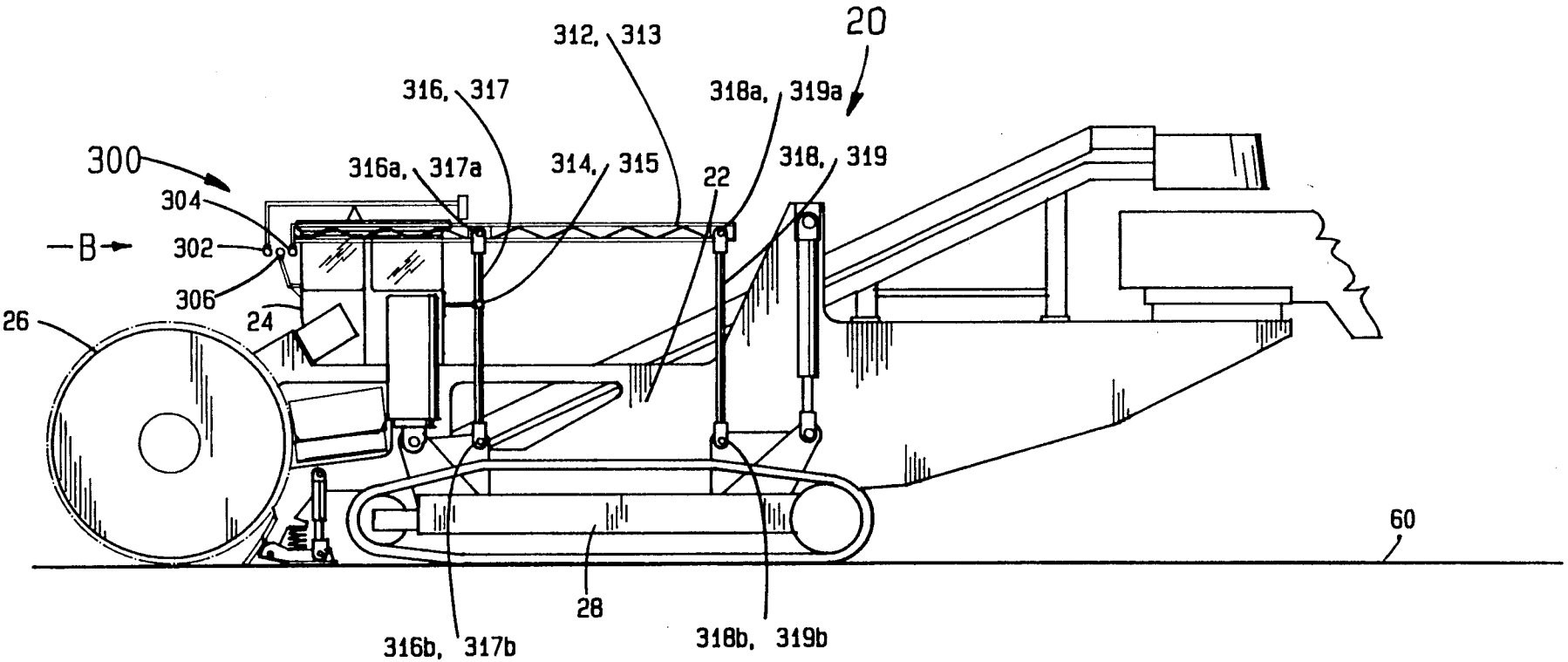
FIG. 13 is a schematic side view of the three bar grade control information display shown as indicating a constant level grade.

FIG. 13 shows the preferred embodiment of the excavating and loading system 20 in accordance with FIG.

1 with the added installation of a three bar grade control information display 300 comprising; transversely mounted Level Grade display bar 302, Existing Grade display bar 304 and Rate of Change display bar 306. The Level Grade bar 302 is attached by means of pendulum bar 308 to beam pitch 310 and the assembly is balanced on fulcrum 311 so that the pitch beam 310 remains level at all times, regardless of changes in the pitch attitude of excavating and loading system 20. The transversely mounted Existing Grade display bar 304 is pivotally connected at each end thereof to right and left grade beams 312 and 313 which in turn are connected to the undercarriage 28 by means of right and left front grade links 316 and 317 and right and left rear grade links 318 and 319. The upper connections 316*a*, 317*a*, 318*a* and 319*a* as well as the lower connections 316*b*, 317*b*, 318*b* and 319*b* are pivotal and all four grade links 316, 317, 318, and 319 are of substantially equal length, parallel and substantially vertical, thus grade beams 312 and 313 are maintained in a substantially parallel relationship with undercarriage 28 and thus to underlying surface 60. Front grade links 316 and 317 pass through guide rings 314 and 315 which thus constrain the Existing Grade bar 304 to movement along a substantially vertical path. In this manner, the position of transverse Existing Grade display bar 304 is determined at all times by the surface supporting the undercarriage 28. The transversely mounted Rate of Change bar 306 is fixed to the control cab 24 which in turn is fixed to the main frame 22, as is the digging wheel 26, thus the position thereof is determined at all times by the elevation of the digging wheel 26 but is constant relative to the control cab 24 in any case.

Figure 14:
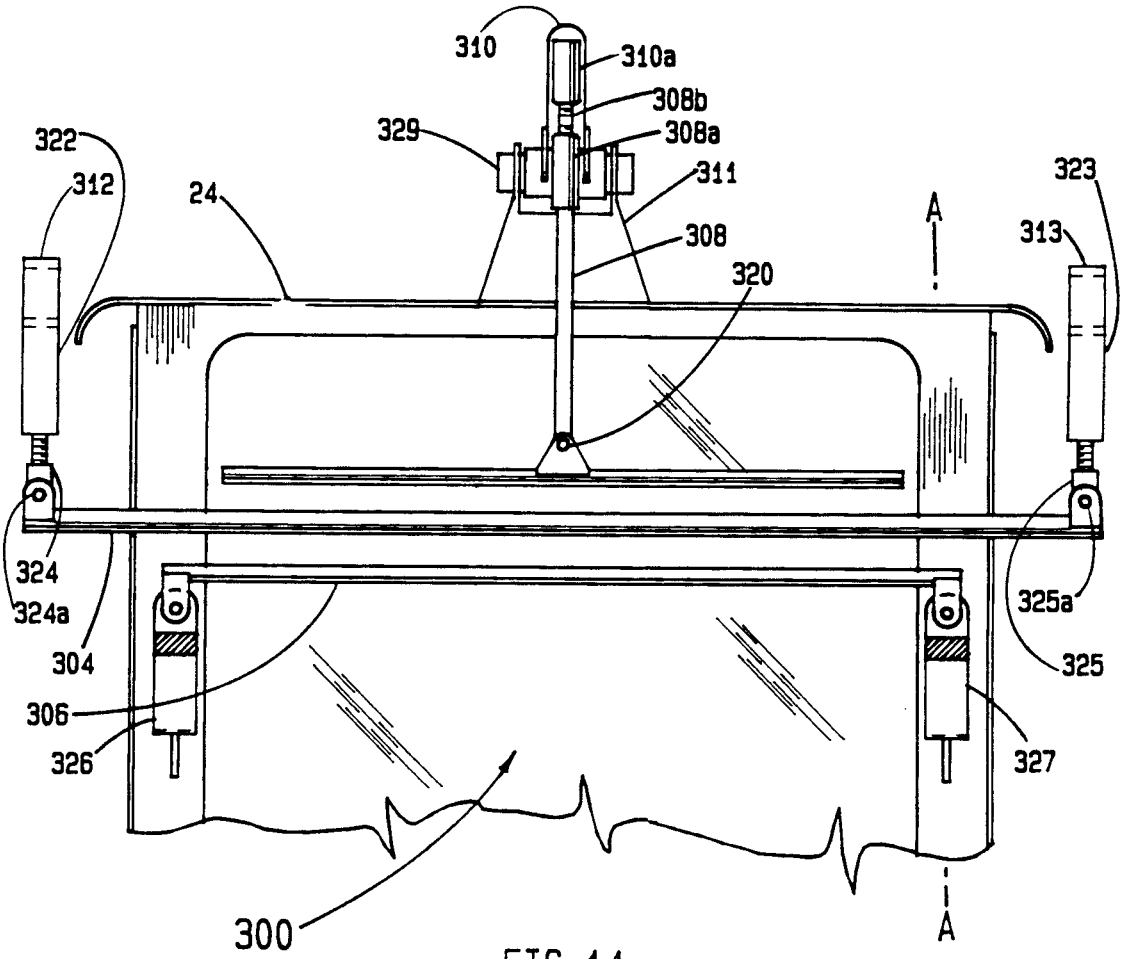
FIG. 14 is a detailed front view taken from the direction "B" of the three bar grade control information display of FIG. 13, shown with the bars spaced as they would be when indicating a rapidly increasing downward grade in order to provide a clear view of the components.

FIG. 14 is a detail view of the three bar grade control information display 300 taken from in front of the control cab 24. In this view the Level Grade bar 302, Existing Grade bar 304 and Rate of Change bar 306 are shown at different elevations, as if indicating a rapid downward transition in order to better disclose the details of construction. The Level Grade bar 302 is shown to be attached to the pendulum bar 308 at pivotal connection 320 thus enabling transverse level indication. The pendulum bar 308 is further shown to comprise nut 308*a* in engagement with one end of threaded connector 308*b* with the second end thereof in engagement with nut 310*a* which comprises a part of pitch beam 310, thus permitting accurate elevation adjustment of bar 302. The fulcrum 311 supports the pitch beam 310 on the low friction pivotal connection 329 whereby the pitch beam 310 is constrained to rotate in only one plane.

The Existing Grade bar 304 is attached to right and left grade beam extensions 322 and 323 at right and left pivotal connections 324*a* and 325*a* by means of threaded connectors 324 and 325 which, in turn engage threaded holes 322*a* and 323*a* in the extensions 322 and 323 respectively. Means for adjustment of the height of Existing Grade bar 304 are thus provided. The Rate of Change bar 306 is rigidly attached at both ends thereof to the front of the control cab 24 by means of right and left vertical extension brackets 326 and 327 which are welded to the structure of the control cab 24. The extension brackets 326 and 327 attach the control cab 24 at an elevation that is well below the anticipated travel range of the Existing Grade bar 304.

Figure 15:
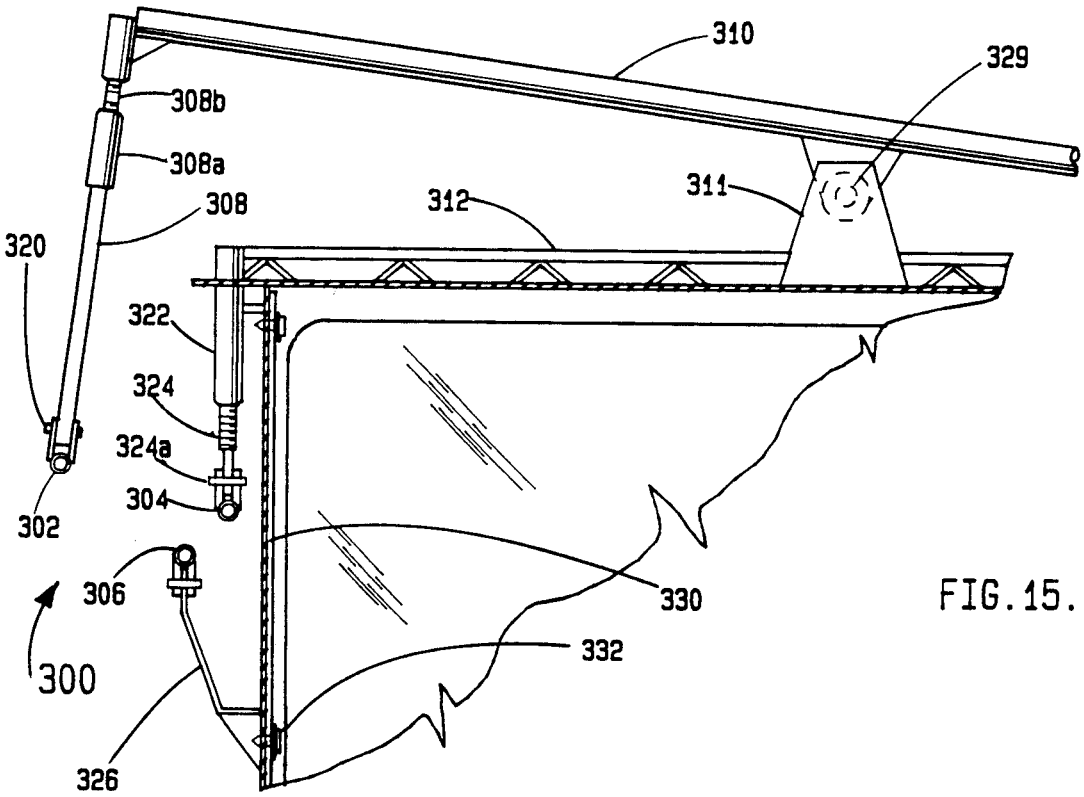
FIG. 15 is a sectional side view of the three bar grade control information display of FIG. 14 taken along the line A—A.

FIG. 15 shows the three bar grade control information display 300 as a sectional detail taken from FIG. 14 along line A—A. The Level Grade bar 302, Existing Grade bar 304 and Rate of Change bar 306 are seen to be spaced apart so that each can be displaced from the nominal constant level grade position without interference with another. With right and left orientation established from the rear of the excavating and loading system looking forward, the right vertical extension bracket 326 is shown, as is the attachment thereof to the control cab 24 and the clearance afforded thereby for movement of the Existing Grade bar 304. Also shown is the right graduated reference plate 330 and the attaching screws 332 which permit position adjustment as required for indexing the reference plate 330 to the nominal constant level grade setting.

Figure 16:
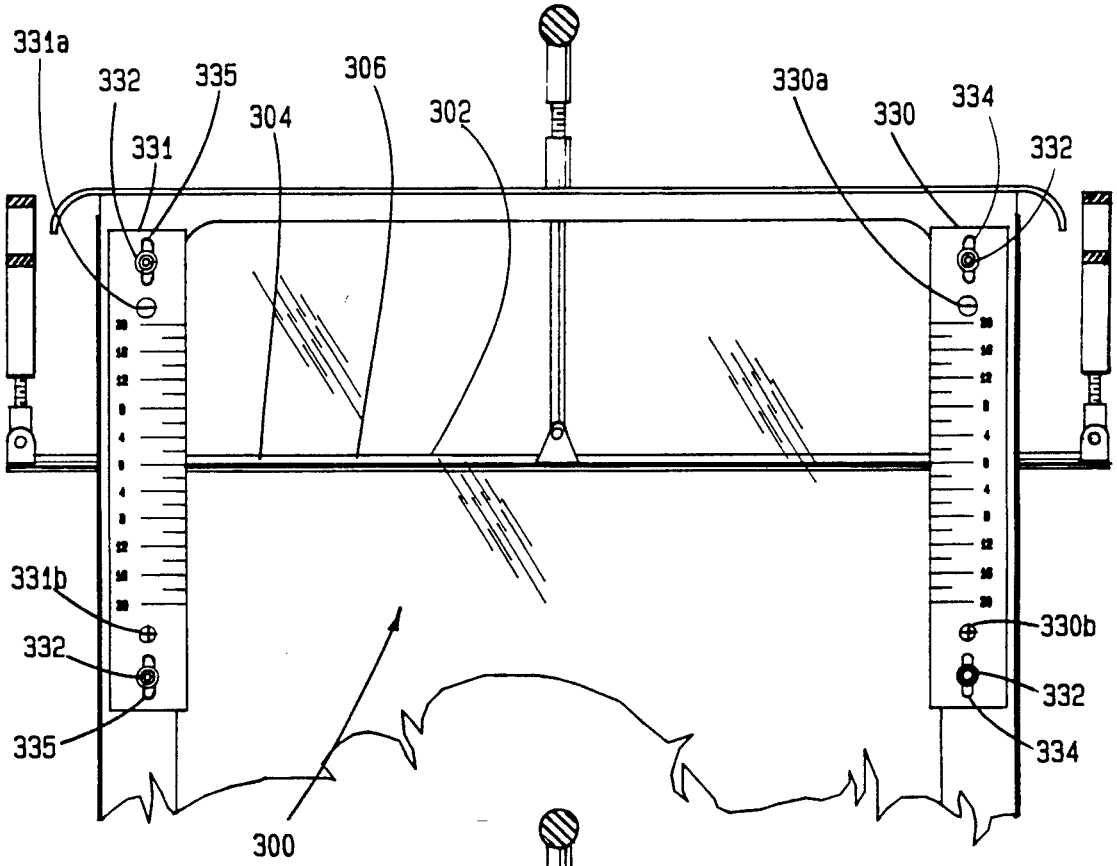
FIG. 16 is a view, as from the operator position inside the control cab, of the three bar grade control information display of FIG. 13, again shown as indicating a constant level grade.

The three bar grade control information display 300 is shown in FIGS. 16 through 22 as indicating various grade related operating situations to the machine operator. The nominal constant level grade situation is shown in FIG. 16 wherein the bars 302, 304 and 306 are seen to all be in alignment and the right and left graduated reference plates 330 and 331 are mounted, in positions indexed by means of attaching screws 332 and slotted mounting holes 334 and 335 so that the "0" marks thereon are also in the same alignment. Graduated reference plates 330 and 331 are calibrated for negative grades down to −20% on ends 330*a* and 331*a* thereof and for positive grades up to +20% on opposite ends 330*b* and 331*b* thereof.

The operator assimilates information from the three bar display 300 in a natural manner by considering the Level Grade bar 302 to represent the horizon and the plane defined by bars 304 and 306 to be inclined the direction of, and in proportion to, his grade change control input. When the plane of bars 304 and 306 slopes toward the Level Grade bar 302, the digging grade is tending toward level and when that plane slopes away from the Level Grade bar 302, the digging grade is increasing.

Figure 17:
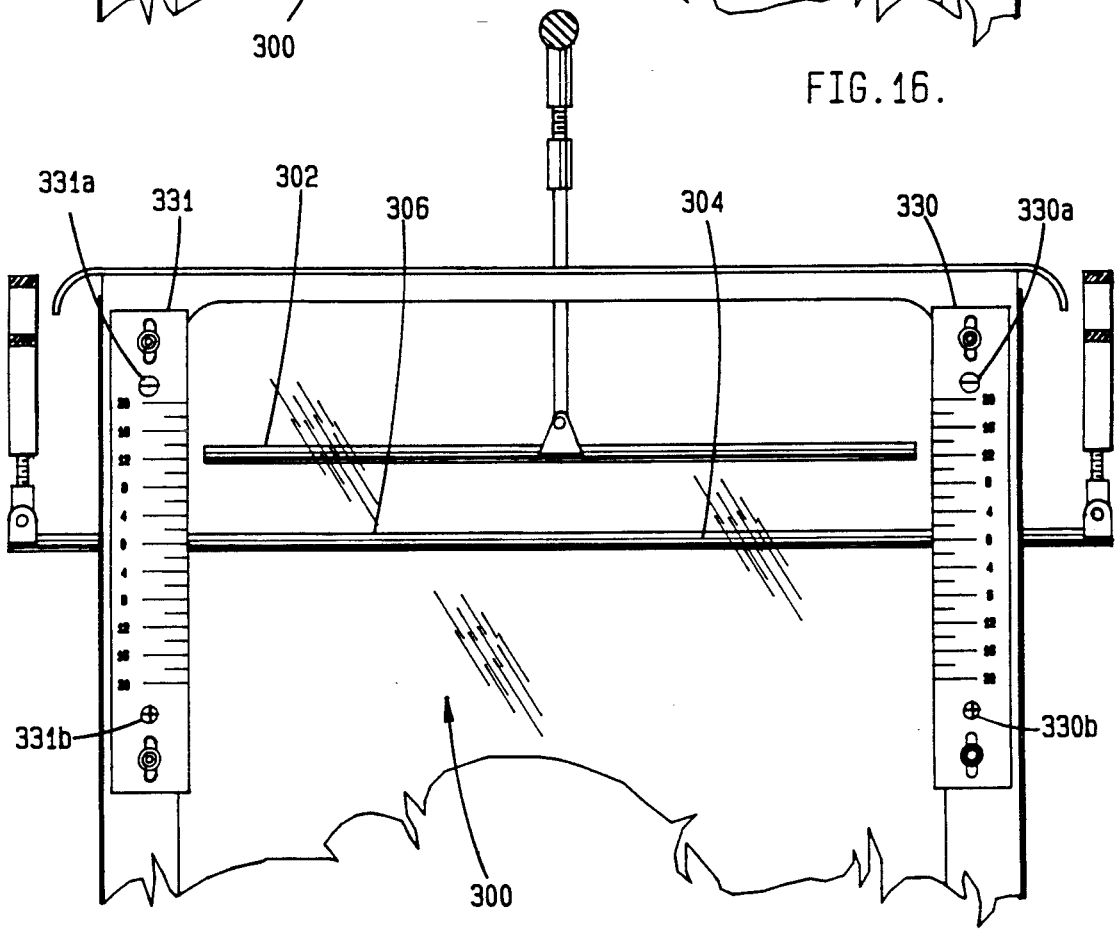
FIG. 17 is a view, as from the operator position inside the control cab, of the three bar grade control information display of FIG. 13, shown as indicating a constant downward grade.
Figure 18:
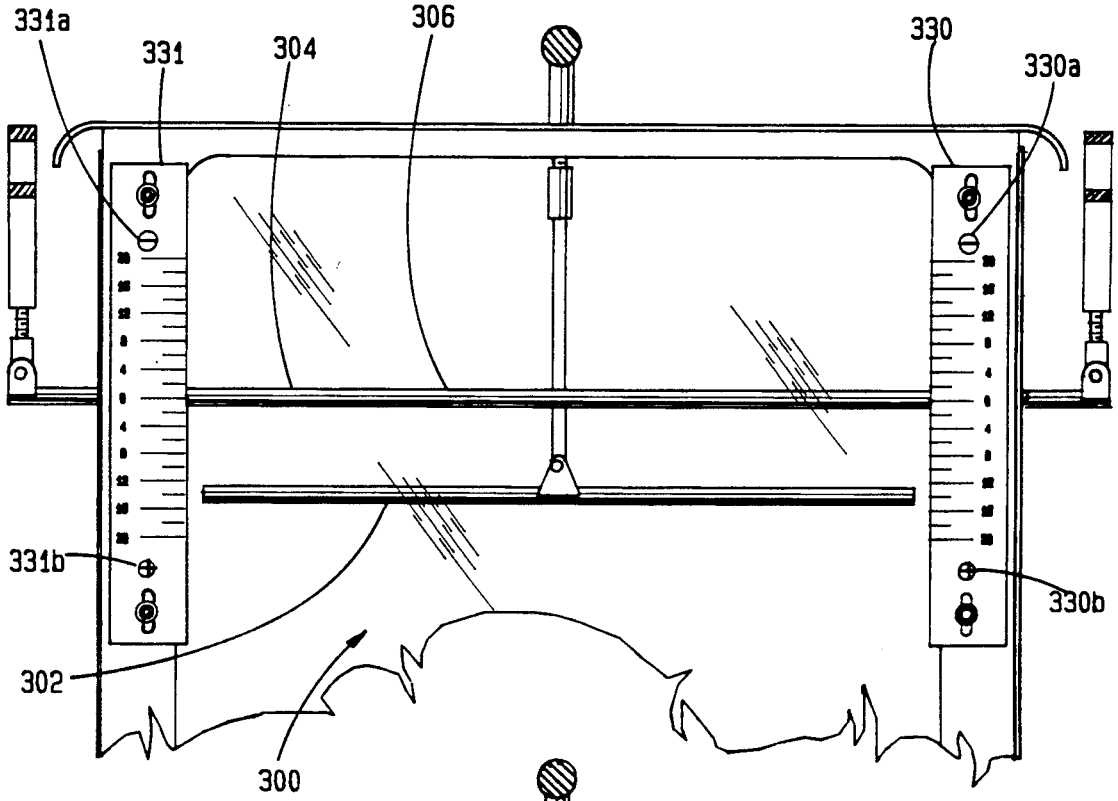
FIG. 18 is a view, as from the operator position inside the control cab, of the three bar grade control information display of FIG. 13, shown as indicating a constant upward grade.

The relationship of the Existing Grade bar 304 and the Rate of Change bar 306 shown in FIG. 17 is unchanged from FIG. 16 but the Level Grade bar 302 is displaced so as to align with the negative "10" mark toward the ends 330*a* and 331*a* of reference plates 330 and 331. This display therefore indicates a constant 10% downward grade with no cross-level deviation. FIG. 18, in a like manner, indicates to the operator that he is digging a constant upward grade. The Level Grade bar is aligned in this case with the positive "14" mark toward the ends 330*b* and 331*b* of reference plates 330 and 331 which shows it to be a 14% upward grade.

Figure 19:
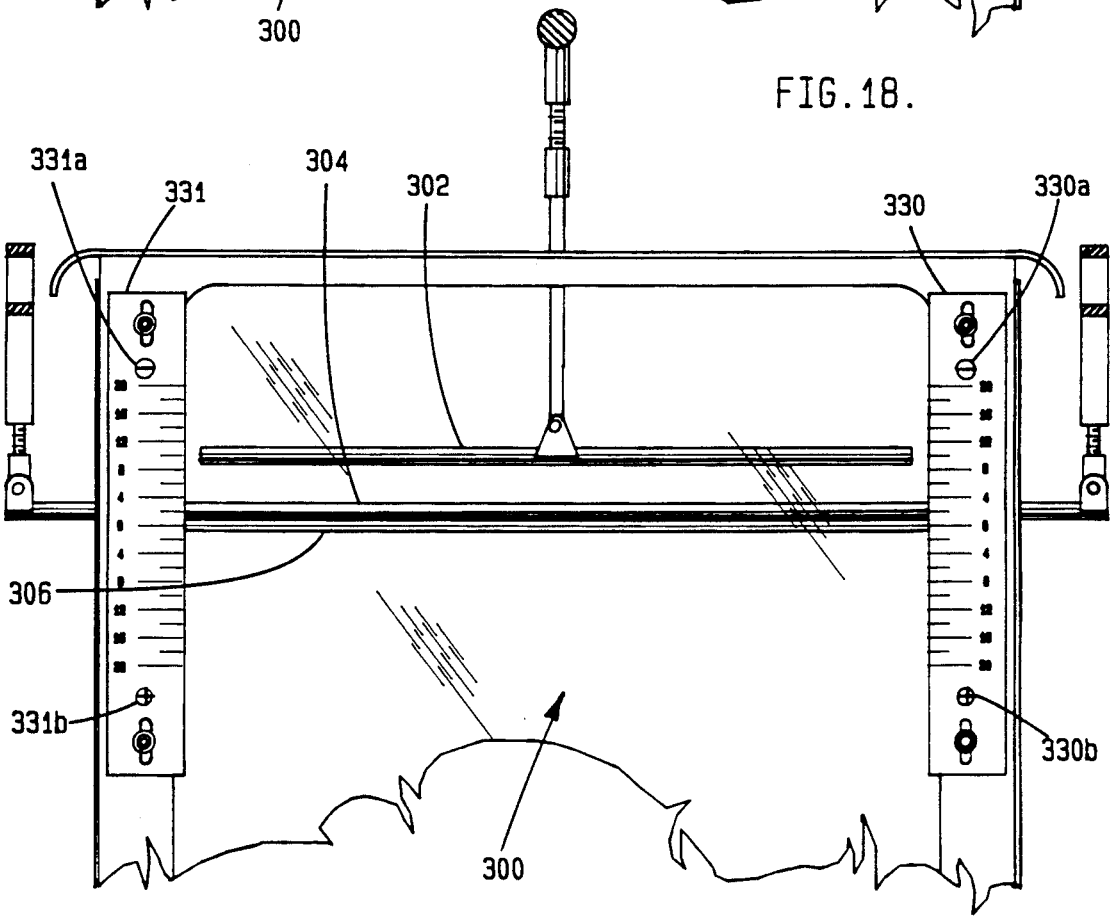
FIG. 19 is a view, as from the operator position inside the control cab, of the three bar grade control information display of FIG. 13, shown as indicating a downwardly directed grade transition.
Figure 20:
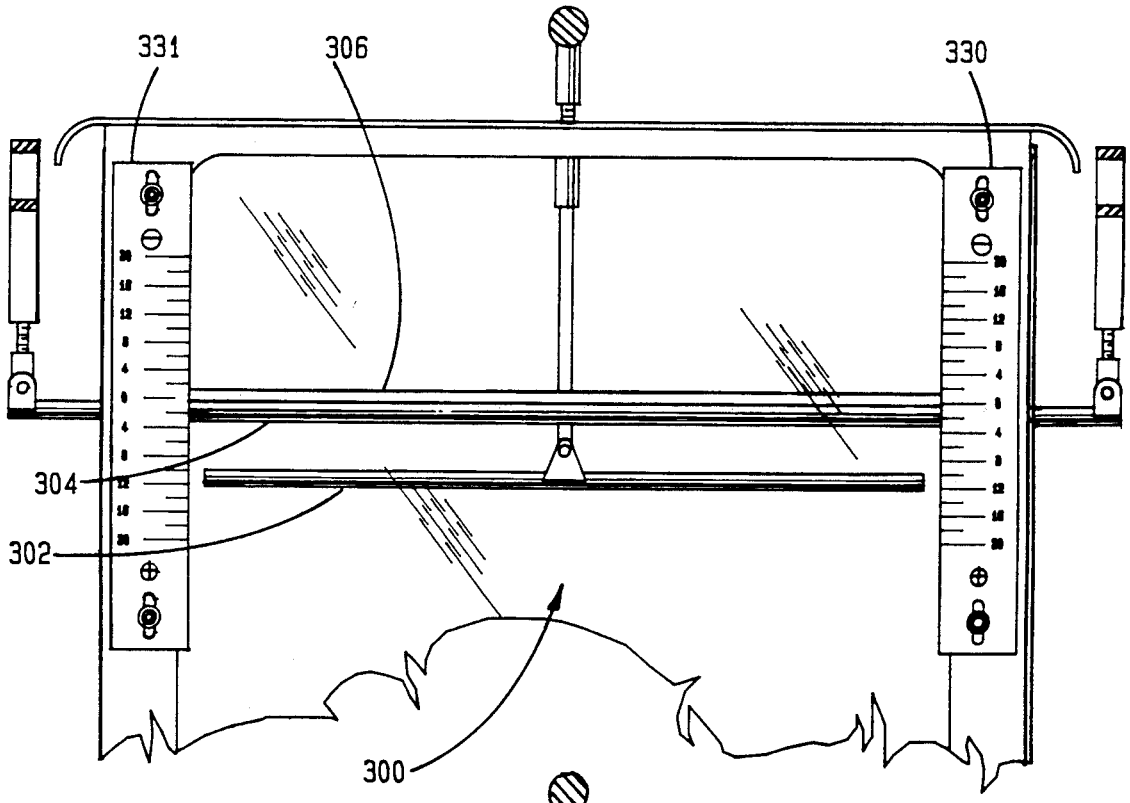
FIG. 20 is a view, as from the operator position inside the control cab, of the three bar grade control information display of FIG. 13, shown as indicating an upwardly directed grade transition.

FIGS. 19 and 20 show the three bar display 300 as indicating downwardly and upwardly trending transitions respectively. In FIG. 19 the Level Grade bar 302 aligns with the negative "10" mark toward the ends 330*a* and 331*a* of the reference plates 330 and 331 showing the grade at that moment is −10% while the Existing Grade bar 304 is seen to be offset from the nominal "0" mark slightly toward the negative on plates 330 and 331 indicating to the operator that the downward grade is increasing. In a similar manner, FIG. 20 shows the three bar display 300 as indicating an 11% upwardly trending grade that is in transition to a steeper upward grade.

Figure 21:
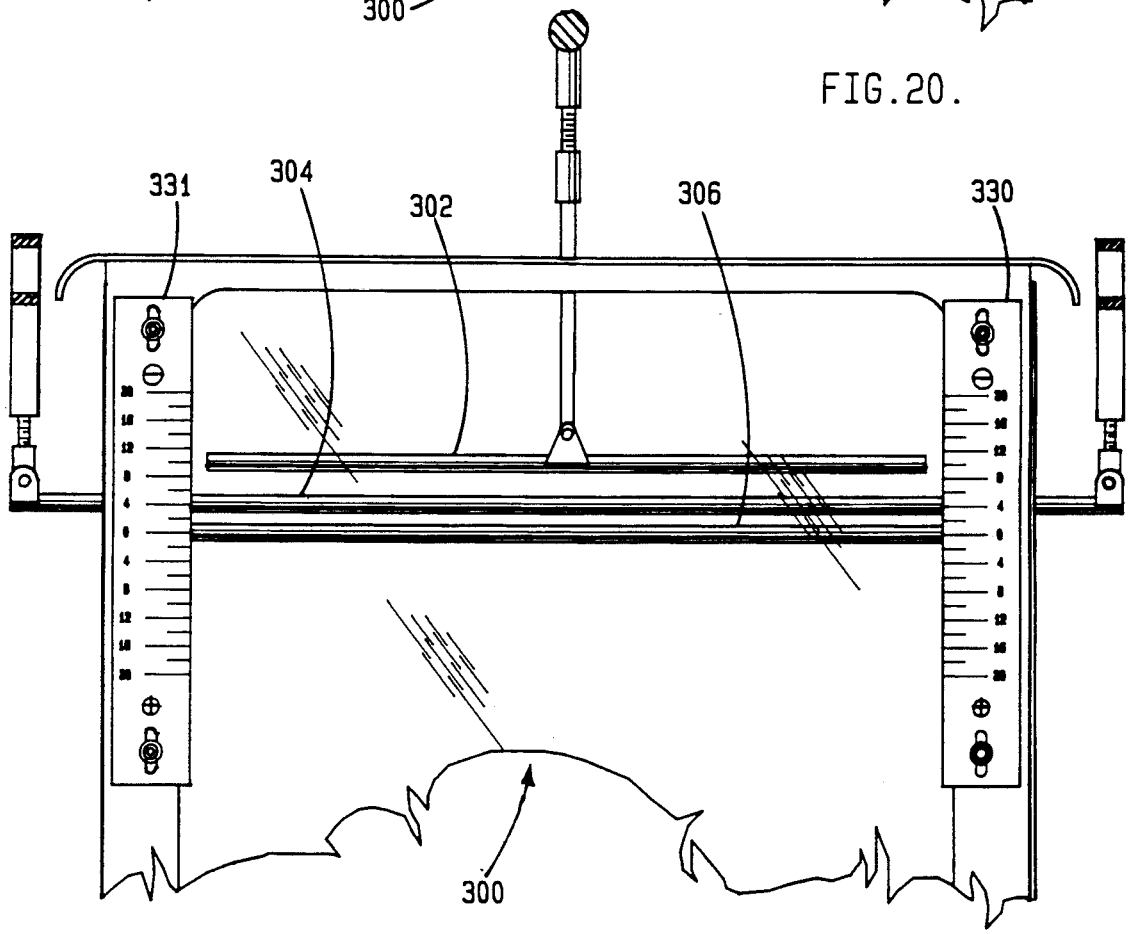
FIG. 21 is a view, as from the operator position inside the control cab, of the three bar grade control information display of FIG. 13, shown as indicating a downwardly directed grade transition at a greater rate of change than that shown in FIG. 19.
Figure 22:
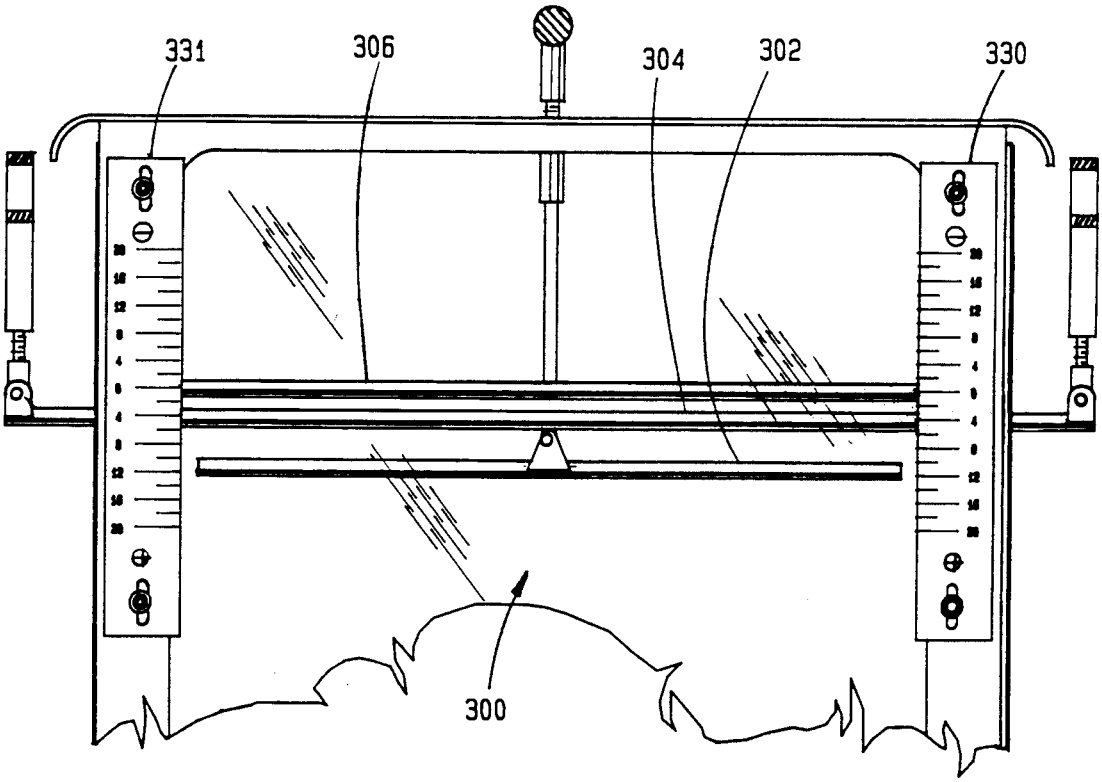
FIG. 22 is a view, as from the operator position inside the control cab, of the three bar grade control information display of FIG. 13, shown as indicating an upwardly directed grade transition at a greater rate of change than that shown in FIG. 20.

FIG. 21 shows the three bar display 300 as indicating a −10% grade situation identical to that shown in FIG. 19 except that the Existing Grade bar 304 is seen to have a greater rate than is indicated in the situation of FIG. 19. In a similar manner, FIG. 22 shows the three bar display 300 as indicating a +11% grade situation identical to that of FIG. 20 except that the Existing Grade bar 304 is seen to have a greater positive offset from the Rate of Change bar 306. This indicates that the grade is trending upwardly at a greater rate than is indicated in the situation of FIG. 20.

Figure 23:
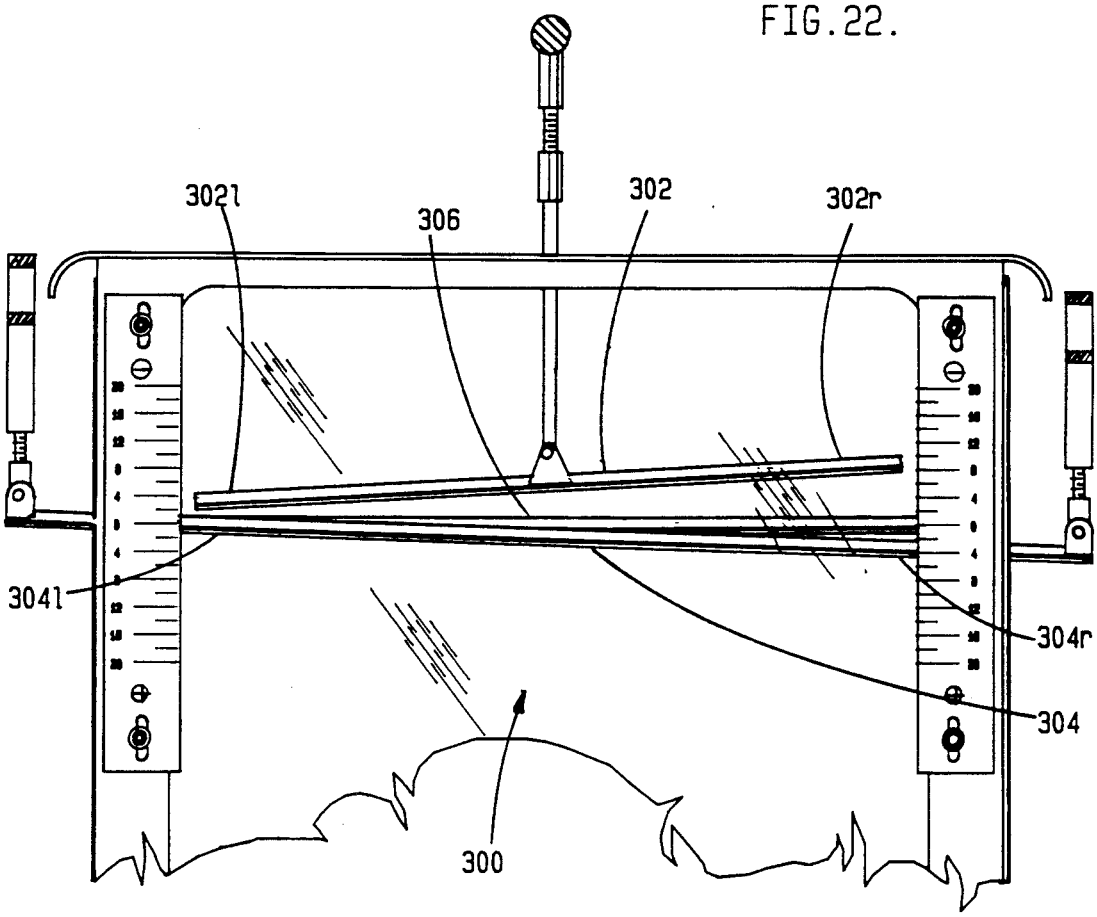
FIG. 23 is a view, as from the operator position inside the control cab, of the three bar grade control information display of FIG. 13, shown as indicating a transverse slope at the bottom of the cut.

The three bar display 300 indicates the level across the width of the cut, or cross-level, in addition to other grade related information as is shown in FIG. 23. Here the right end 302*r* of the Level Grade bar 302 is shown to with negative "10" on the reference plate 330 while the left end 3021 is shown to align with negative "4". This indicates to the operator that the right side of the cut is running deeper than the left and the corrective control input is indicated by the positive offset of the right end 304*r* of Existing Grade bar 304 relative to the Rate of Change bar 306. The left end 3041 of Existing Grade bar 304 is shown to be aligned with Rate of Change bar 306 indicating that the grade on the left side of the cut is held at a constant −4% while cross-level is being corrected.

Figure 24:
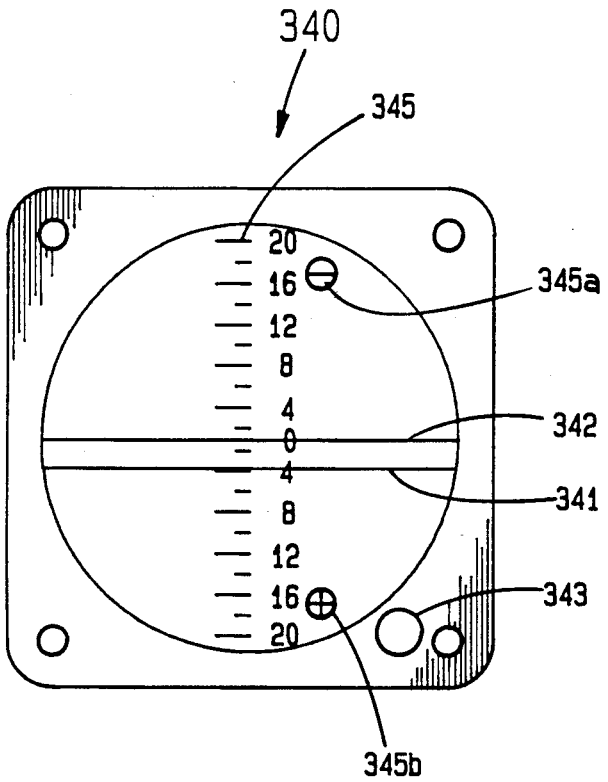
FIG. 24 shows a gyroscopic artificial horizon indicating instrument as adapted for grade control information display purposes.

The adaptation of an aeronautical artificial horizon instrument 340 is shown in FIG. 24. The horizon indicator 341 of the instrument 340 is designated as the Level Grade line and the attitude reference indicator 342 is designated as the Existing Grade line. Gauge means 345 are provided so that the position of the Existing Grade line 342 may be quantitatively related to the Level Grade line 341. The gauge means 345 indicates negative grades down to −20% toward end 345*a* and positive grades up to +20% at the opposite end 345*b*. Calibration means 343 is provided to position the Existing Grade line 342 relative to the "0" mark of gauge calibration means 345 under nominal conditions. As shown in FIG. 24, the existing grade line 342 is set on "0" for cutting a nominal "0" slope grade and the level grade line 341 indicates that the machine is on a positive (up) grade.

Figure 26:
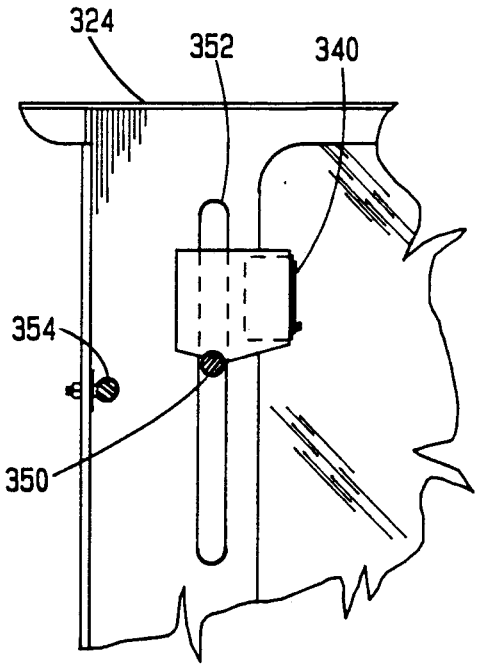
FIG. 26 sectional shows a sectional side view of the mounting of the gyroscopic artificial horizon indicator of FIG. 25.
Figure 25:
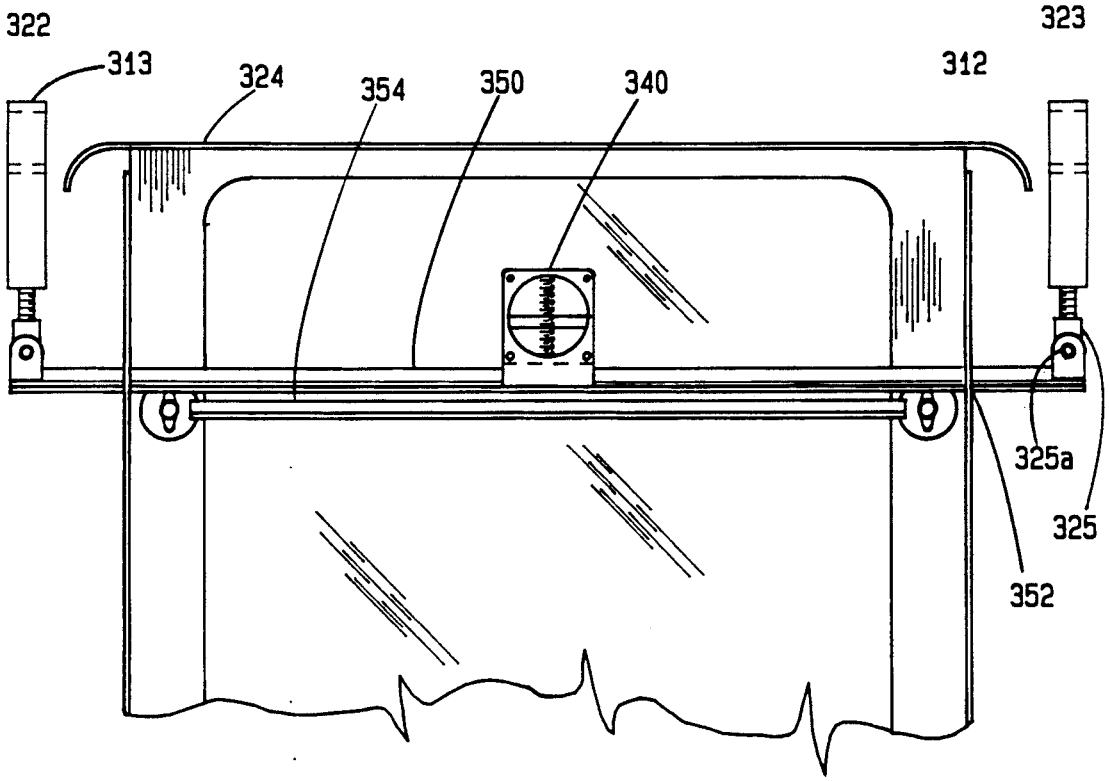
FIG. 25 is a grade control information display utilizing a gyroscopic artificial horizon indicator.

FIGS. 25 and 26 show the artificial horizon instrument 340 to be mounted directly to alternate Existing Grade bar 350 which in turn is coupled as previously shown in FIG. 13 to the undercarriage 28 thus maintaining the attitude of the instrument 340 constant in relationship to the existing grade as previously defined. In this case however, the alternate Existing Grade bar 350 penetrates the interior of control cab, 324 in a fixed position so that it is aligned with the Rate of Change bar 354 in any constant grade condition. The elevation of the Existing Grade bar 350 relative to the fixed position of the Rate of Change bar 354 provides the operator with all needed information as to changing or constant grade conditions.

Figure 27:
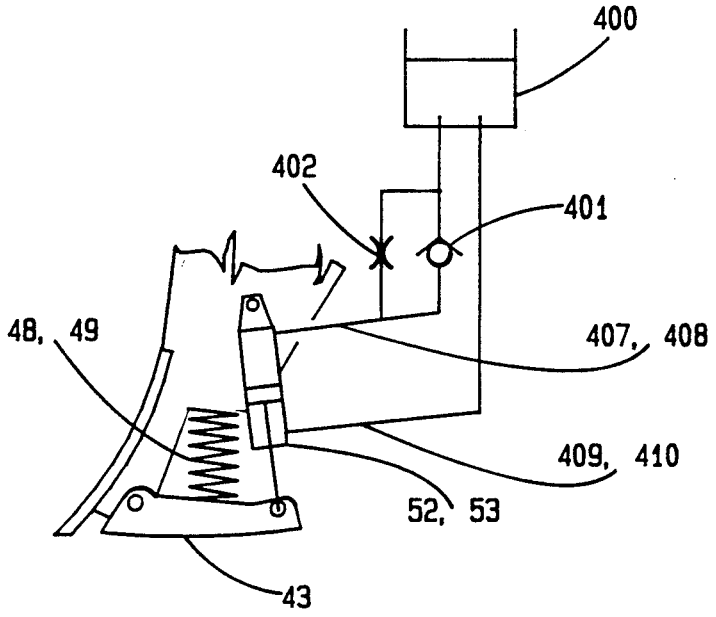
FIG. 27 shows a hydraulic schematic circuit diagram for skid plate damping cylinder means.

FIG. 27 shows a schematic diagram of the hydraulic circuit supplying the damping hydraulic cylinders 52 and 53 of FIG. 1. The skid plate 43 is shown to be urged in a clockwise direction against an underlying surface. The cylinder hydraulic lines 407, 408, 409 and 410 are connected to the hydraulic tank 400 and therefor the system is passive or non-powered. Hydraulic fluid required for extension of cylinders 52 and 53 is supplied with minimal restriction in the free-flow direction of check valve 401, thus allowing relatively rapid extension of said cylinders when required. Flow of fluid displaced by the retraction or collapse of cylinders 52 and 53 is forced to pass through orifice 402 as it is returned to the tank 400 because check valve 401 blocks flow in this direction. The restriction of orifice 402 greatly reduces the counter-clockwise movement rate of skid plate 43 thus helping to sustain its position under shock loads and allowing it to adjust position on changing grades.

Figure 28:
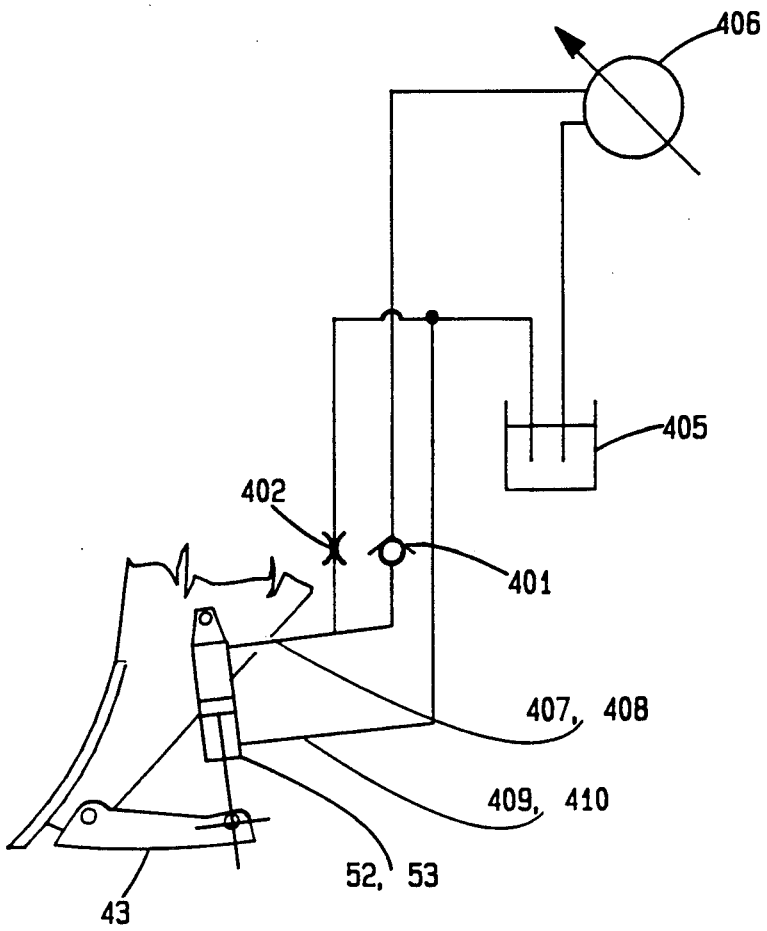
FIG. 28 shows a hydraulic schematics circuit diagram for adaptation of hydraulic cylinders as compression spring means for the skid plate.

FIG. 28 shows a schematic diagram of a hydraulic circuit as would be used to urge the skid plate 43 of FIG. 1 in a clockwise direction, against an underlying surface, where the friction of compression springs is assumed by hydraulic cylinders 52 and 53.

Pressurized hydraulic fluid is supplied on demand by pressure compensated hydraulic pump 406 which increases or reduces its output flow rate on demand while maintaining a constant output pressure at all times. Fluid pressure is thus maintained on hydraulic lines 407 and 408 causing cylinders 52 and 53 to urge skid plate 43 in a clockwise direction. As in FIG. 27, rapid flow is permitted through check valve 401 into the cylinders 52 and 53 and a restricted flow is permitted from the cylinders through orifice 402 to tank 406. Flow through orifice 402 is much less than the output capacity of pump 406 so that the cylinders 52 and 53 are urged to extend.

When a force sufficient to overcome the clockwise force on skid plate 43 is encountered, pressure in lines 407 and 408 increases above the shut off pressure capacity of the pump 406 which reduces its output flow to zero. Check valve 401 blocks any fluid flow toward pump 406 and the skid plate 43 is allowed to move slowly counter-clockwise thus permitting it to absorb shock loads and adjust position on changing grades. Fluid is allowed to flow through lines 409 and 410 in either direction at all times as required to allow movement in cylinders 52 and 53.

Although particular embodiments of the invention have been illustrated in the accompanying Drawings and described in the foregoing Detailed Description, it will be understood that the invention is not limited to the embodiments disclosed, but is capable of rearrangement, modification and substitution of parts and elements without departing from the spirit and scope of the invention as defined in the appended claims.

I claim:

1. An excavating and loading system comprising:

a main frame;

a surface contacting undercarriage having first and second ends;

connecting means for supporting said main frame on said undercarriage;

a bucket wheel wider than any other party of said excavating and loading system;

structure extending from one end of said main frame supporting said bucket wheel for rotational movement;

drive means for continuously rotating said bucket wheel;

undercarriage drive means for advancing said continuously rotating bucket wheel so as to cut the surface contacted by said undercarriage;

adjustment means for varying the elevation of said bucket wheel relative to said undercarriage so that the surface contacting portions thereof, in conjunction with the periphery of said bucket wheel, determine a cylindrical surface of consequently adjusted radius; and positioning means for holding the surface contacting portion of said smoothing means inherently proximate to said cylindrical surface.

2. An excavating and loading system according to claim 1 wherein said undercarriage comprises a crawler track mounted system.

3. An excavating and loading system according to claim 1 wherein said undercarriage comprises a wheel mounted system.

4. An excavating and loading system according to claim 1 wherein said smoothing means comprises:

a transverse moldboard connected to said main frame, between said bucket wheel and said undercarriage, for urging passed material into said bucket wheel; and a blade edge on said moldboard to clean and even the surface cut by said bucket wheel;

a skid plate pivotally connected to the undercarriage facing side of said moldboard near said blade edge; and substantially constant force means for urging said skid plate into contact with the surface cut by said bucket wheel.

5. An excavating and loading system according to claim 4 wherein said substantially constant force means comprises a mechanical spring.

6. An excavating and loading system according to claim 4 wherein said substantially constant force means comprises a hydraulic actuator.

7. An excavating and loading system according to claim 4 further comprising means for limiting the upward rate of pivotal movement of said skid plate.

8. An excavating and loading system according to claim 7 wherein said limiting means comprises:

a hydraulic cylinder having first and second ends wherein said first end is fixed relative to said mold board and said second end is connected to said skid plate;

fluid system means for said hydraulic cylinder so that fluid flows out of said cylinder as said skid plate pivots upwardly; and flow control means for limiting the rate of fluid flow out of said cylinder.

9. An excavating and loading system according to claim 1 wherein said adjustment means for bucket wheel elevation effects pivotal movement of said main frame about a transverse axis at the first end of said undercarriage.

10. An excavating and loading system according to claim 9 wherein said positioning means comprises:

said main frame being mounted for rotation about said undercarriage at a location between said smoothing means and the surface contacting portions of said undercarriage, and above said cylindrical surface, so that said positioning means is implemented by said adjustment means without moving said smoothing means relative to said main frame.

11. An excavating and loading system according to claim 9 wherein said positioning means comprises:

structural support means for said smoothing means pivotally connected to said main frame; and linkage means connected to said undercarriage for positioning said smoothing means relative to said cylindrical surface.

12. An excavating and loading system according to claim 9 wherein said positioning means comprises:

structural support means for said smoothing means pivotally connected to said undercarriage; and linkage means connected to said main frame for positioning said smoothing means relative to said cylindrical surface.

13. An excavating and loading system comprising:

a main frame;

a surface contacting undercarriage having first and second ends;

connecting means for supporting said main frame on said undercarriage;

a bucket wheel wider than said undercarriage;

structure extending from one end of said main frame supporting said bucket wheel for rotational movement;

drive means for continuously rotating said bucket wheel;

undercarriage drive means for advancing said continuously rotating bucket wheel so that is cuts a longitudinally and transversely inclined surface for contact by said undercarriage;

smoothing means located between said bucket wheel and said undercarriage for cleaning and evening the surface cut by said bucket wheel;

adjustment means for varying the elevation of said bucket wheel relative to said undercarriage so that the surface contacting portions thereof, in conjunction with the periphery of said bucket wheel and the lowermost edge of said smoothing means, determine a cylindrical surface of consequently adjusted radius; and first reference means for indicating the inclination of said inclined surface; and second reference means responsive to the radius of said cylindrical surface for indicating the rate of change of inclination of said inclined surface.

14. An excavating and loading system according to claim 13 wherein said first reference means comprises:

a first indicator responsive to the longitudinal and transverse inclination of said inclined surface; and a second indicator positioned relative to said bucket wheel to provide a datum reference for said first indicator.

15. An excavating and loading system according to claim 13 wherein said second reference means comprises:

a first indicator responsive to the elevation of said bucket wheel relative to the second end of said undercarriage; and a second indicator positioned relative to said bucket wheel to provide a datum reference for said first indicator.

16. An excavating and loading system according to claim 13 wherein said first reference means comprises:

gyroscopic artificial horizon means for indicating the inclination of said inclined surface.

17. An excavating and loading system according to claim 13 wherein said first reference means comprises:

a gyroscopic artificial horizon indicator mounted so that the indication thereof is responsive to the inclination of said undercarriage and thereby to the inclination of said inclined surface.

18. An excavating and loading system according to claim 13 wherein said second reference means comprises:

a first transverse reference bar having right and left ends fixedly positioned relative to said main frame;

a second transverse reference bar having right and left ends corresponding to the right and left ends of said first transverse reference bar and movably positioned adjacent thereto; and right and left end moving means for moving said second transverse reference bar responsive to the elevation of said bucket wheel relative to the right and left sides of the second end of said undercarriage.

19. An excavating and loading system according to claim 18 wherein said right and left end moving means comprises:

right and left grade beams, having first and second ends, longitudinally disposed along either side of said main frame so that each grade beam first end supports the respective right or left transverse reference bar end;

linkage means on either side of said main frame for connecting said right and left grade beams to said undercarriage and changing the position of said grade beam in response to changes of inclination of said inclined surface so that the right and left transverse bar ends are raised or lowered accordingly.

20. An excavating and loading system according to claim 18 wherein said first reference means is a gyroscopic artificial horizon mounted directly to said second transverse reference bar.

21. An excavating and loading system according to claim 19 wherein said first reference means is a gyroscopic artificial horizon mounted directly to said second transverse reference bar.

22. An excavating and loading system according to claim 13 wherein said first reference means comprises:

a first indicator responsive to the longitudinal inclination of said inclined surface;

a second indicator responsive to the transverse inclination of said inclined surface; and reference means positioned relative to said bucket wheel to provide a datum reference for said first and second indicators.

23. An excavating and loading system according to claim 13 wherein said first reference means comprises:

a gyroscopic artificial horizon indicator mounted to said main frame so that the indication thereof is responsive to the inclination of said inclined surface by the influence thereof on the inclination of said main frame.

24. An excavating and loading system according to claim 13 wherein said second reference means comprises:

a first indicator responsive to the elevation of said bucket wheel relative to the surface contacting said undercarriage; and a second indicator positioned relative to said bucket wheel to provide a datum reference for said first indicator.

25. An excavating and loading system according to claim 24 wherein said first reference means comprises:

gyroscopic artificial horizon means for indicating the inclination of said inclined surface.

26. An excavating and loading system according to claim 24 wherein said first reference means comprises:

a gyroscopic artificial horizon indicator mounted so that the indication thereof is responsive to the inclination of said undercarriage and thereby to the inclination of said inclined surface.

27. An excavating and loading system according to claim 24 wherein said second reference means comprises:

a gyroscopic artificial horizon indicator mounted to said main frame so that the indication thereof is responsive to the inclination of said inclined surface by the influence thereof on the inclination of said main frame.

28. A method for controlling the grade of a surface cut by a machine which advances on said surface, wherein the upgrade controlling elements of said machine comprise the periphery of a bucket wheel, the forward and rearward ground contacting portions of an undercarriage and the lowermost edge of a smoothing means comprising:

selecting the grade of a surface to be cut;

determining the present grade upon which said machine is advancing;

comparing said selected grade to said present grade;

finding the deviation of said selected grade relative to said present grade;

arranging the grade controlling elements of said machine to lie along a cylindrical surface of a radius inversely related to said deviation;

monitoring the changing deviation of the grade upon which said machine is advancing relative to said selected grade; and rearranging the grade controlling elements of said machine to lie along a cylindrical surface of a radius inversely related to the changed deviation so that as said deviation approaches zero, said radius approaches infinity.

29. A method for changing the grade of a surface cut by a machine which advances on said surface wherein the grade controlling elements of said machine comprise the periphery of a bucket wheel, the lowermost edge of a smoothing means, and the forward and rearward ground contacting portions of an undercarriage comprising:

aligning said grade controlling elements of said machine to lie along a flat plane;

advancing said machine so as to cut a surface to a first constant grade;

rearranging said grade controlling elements of said machine to lie along a cylindrical surface;

advancing said machine so as to cut a cylindrical surface tangent to said first constant grade;

realigning said grade controlling elements of said machine to again lie along a flat plane; and advancing said machine so as to cut a surface to a second constant grade tangent to said cylindrical surface.

30. An excavating and loading system comprising:

a main frame;

a surface contacting undercarriage having first and second ends;

connecting means for supporting said main frame on said undercarriage;

bucket excavating means wider than said undercarriage;

structure extending from one end of said main frame supporting said bucket excavating means for rotational movement;

drive means for continuously operating said bucket excavating means;

undercarriage drive means for advancing said continuously operating bucket excavating means so as to cut the surface contacted by said undercarriage;

smoothing means located between said bucket excavating means and said undercarriage for cleaning and evening the surface cut by said bucket excavating means;

adjustment means for varying the elevation of said bucket excavating means relative to said undercarriage so that the surface contacting portions of said undercarriage, in conjunction with the periphery of said bucket excavating means, determine a cylindrical surface of consequently adjusted radius; and positioning means for holding the surface contacting portion of said smoothing means inherently proximate to said cylindrical surface.

31. An excavating and loading system according to claim 30 wherein said undercarriage comprises a crawler track mounted system.

32. An excavating and loading system according to claim 30 wherein said undercarriage comprises a wheel mounted system.

33. An excavating and loading system according to claim 30 wherein said smoothing means comprises:

a transverse moldboard connected to said main frame, between said bucket excavating means and said undercarriage, for urging passed material into said bucket excavating means;

a blade edge on said moldboard to clean and even the surface cut by said bucket excavating means;

a skid plate pivotally connected to the undercarriage facing side of said moldboard near said blade edge; and substantially constant force means for urging said skid plate into contact with the surface cut by said bucket excavating means.

34. An excavating and loading system according to claim 33 wherein said substantially constant force means comprises a mechanical spring.

35. An excavating and loading system according to claim 33 wherein said substantially constant force means comprises a hydraulic actuator.

36. An excavating and loading system according to claim 33 further comprising means for limiting the upward rate of pivotal movement of said skid plate.

37. An excavating and loading system according to claim 36 wherein said limiting means comprises:

a hydraulic cylinder having first and second ends wherein said first end is fixed relative to said moldboard and said second end is connected to said skid plate;

fluid system means for said hydraulic cylinder so that fluid flows out of said cylinder as said skid plate pivots upwardly; and flow control means for limiting the rate of fluid flow out of said cylinder.

38. An excavating and loading system according to claim 30 wherein said adjustment means for varying the elevation of said bucket excavating means effects pivotal movement of said main frame about a transverse axis at the first end of said undercarriage.

39. An excavating and loading system according to claim 38 wherein said positioning means comprises:

said main frame being mounted for rotation about said undercarriage at a location between said smoothing means and the surface contacting portions of said undercarriage, and above said cylindrical surface, so that said positioning means is implemented by said adjustment means without moving said smoothing means relative to said main frame.

40. An excavating and loading system according to claim 38 wherein said positioning means comprises:

structural support means for said smoothing means pivotally connected to said main frame; and linkage means connected to said undercarriage for positioning said smoothing means relative to said cylindrical surface.

41. An excavating and loading system according to claim 38 wherein said positioning means comprises:

structural support means for said smoothing means pivotally connected to said undercarriage; and linkage means connected to said main frame for positioning said smoothing means relative to said cylindrical surface.

42. An excavating and loading system comprising:

a main frame;

a surface contacting undercarriage having first and second ends;

connecting means for supporting said main frame on said undercarriage;

bucket excavating means wider than said undercarriage;

structure extending from one end of said main frame supporting said bucket excavating means for continuous excavation;

drive means for continuously operating said bucket excavating means;

undercarriage drive means for advancing said continuously operating bucket excavating means so as to cut a longitudinally and transversely inclined surface for contact by said undercarriage;

smoothing means located between said bucket excavating means and said undercarriage for cleaning and evening the surface cut by said bucket excavating means;

adjustment means for varying the elevation of said bucket excavating means relative to said undercarriage so that the surface contacting portions thereof, in conjunction with the periphery of said bucket excavating means and the lowermost portion of said smoothing means, determine a cylindrical surface of consequently adjusted radius;

first reference means for indicating the inclination of said inclined surface; and second reference means responsive to the radius of said cylindrical surface for indicating the rate of change of inclination of said inclined surface.

43. An excavating and loading system according to claim 42 wherein said first reference means comprises:

a first indicator responsive to the longitudinal and transverse inclination of said inclined surface; and a second indicator positioned relative to said bucket wheel to provide a datum reference for said first indicator.

44. An excavating and loading system according to claim 42 wherein said second reference means comprises:

a first indicator responsive to the elevation of said bucket wheel relative to the second end of said undercarriage; and a second indicator positioned relative to said bucket wheel to provide a datum reference for said first indicator.

45. An excavating and loading system according to claim 42 wherein said first reference means comprises:

gyroscopic artificial horizon means for indicating the inclination of said inclined surface.

46. An excavating and loading system according to claim 42 wherein said first reference means comprises:

a gyroscopic artificial horizon indicator mounted so that the indication thereof is responsive to the inclination of said undercarriage and thereby to the inclination of said inclined surface.

47. An excavating and loading system according to claim 42 wherein said second reference means comprises:

a first transverse reference bar having right and left ends fixedly positioned relative to said main frame;

a second transverse reference bar having right and left ends corresponding to the right and left ends of said first transverse reference bar and movably positioned adjacent thereto; and right and left end moving means for moving said second transverse reference bar responsive to the elevation of said bucket wheel relative to the right and left sides of the second end of said undercarriage.

48. An excavating and loading system according to claim 47 wherein said right and left end moving means comprises:

right and left grade beams, having first and second ends, longitudinally disposed along either side of said main frame so that each grade beam first end supports the respective right or left transverse reference bar end;

linkage means on either side of said main frame for connecting said right and left grade beams to said undercarriage and changing the position of said grade beam in response to changes of inclination of said inclined surface so that the right and left transverse bar ends are raised or lowered accordingly.

49. An excavating and loading system according to claim 48 wherein said first reference means is a gyroscopic artificial horizon mounted directly to said second transverse reference bar.

50. An excavating and loading system according to claim 47 wherein said first reference means is a gyroscopic artificial horizon mounted directly to said second transverse reference bar.

51. An excavating and loading system according to claim 42 wherein said first reference means comprises:

a first indicator responsive to the longitudinal inclination of said inclined surface;

a second indicator responsive to the transverse inclination of said inclined surface; and reference means positioned relative to said bucket excavating means to provide a datum reference for said first and second indicators.

52. An excavating and loading system according to claim 42 wherein said first reference means comprises:

a gyroscopic artificial horizon indicator mounted to said main frame so that the indication thereof is responsive to the inclination of said inclined surface by the influence thereof on the inclination of said main frame.

53. An excavating and loading system according to claim 42 wherein said second reference means comprises:

a first indicator responsive to the elevation of said bucket excavating means relative to the surface contacting said undercarriage; and a second indicator positioned relative to said bucket excavating means to provide a datum reference for said first indicator.

54. An excavating and loading system according to claim 53 wherein said first reference means comprises:

gyroscopic artificial horizon means for indicating the inclination of said inclined surface.

55. An excavating and loading system according to claim 53 wherein said first reference means comprises:

a gyroscopic artificial horizon indicator mounted so that the indication thereof is responsive to the inclination of said undercarriage and thereby to the inclination of said inclined surface.

56. An excavating and loading system according to claim 53 wherein said second reference means comprises:

a gyroscopic artificial horizon indicator mounted on said main frame so that the indication thereof is responsive to the inclination of said inclined surface by the influence thereof on the inclination of said main frame.

57. A method for controlling the grade of a surface cut by a machine which advances on said surface, wherein the grade controlling elements of said machine comprise the periphery of a bucket excavating means, the forward and rearward ground contacting portions of an undercarriage and the lowermost edge of a smoothing means comprising:

selecting the grade of a surface to be cut;

determining the present grade upon which said machine is advancing;

comparing said selected grade to said present grade;

finding the deviation of said selected grade relative to said present grade;

arranging the grade controlling elements of said machine to lie along a cylindrical surface of a radius inversely related to said deviation;

monitoring and changing deviation of the grade upon which said machine is advancing relative to said selected grade; and rearranging the grade controlling elements of said machine to lie along a cylindrical surface of a radius inversely related to the changed deviation so that as said deviation approaches zero, said radius approaches infinity.

58. A method for changing the grade of a surface cut by a machine which advances on said surface wherein the grade controlling elements of said machine comprise the periphery of a bucket excavating means, the lowermost edge of a smoothing means, and the forward and rearward ground contacting portions of an undercarriage comprising:

aligning said grade controlling elements of said machine to lie along a flat plane;

advancing said machine so as to cut a surface to a first constant grade;

rearranging said grade controlling elements of said machine to lie along a cylindrical surface;

advancing said machine so as to cut a cylindrical surface tangent to said first constant grade;

realigning said grade controlling elements of said machine to again lie along a flat plane; and advancing said machine so as to cut a surface to a second constant grade tangent to said cylindrical surface.

* * * * *